US010040287B2

(12) United States Patent
Chikamoto

(10) Patent No.: US 10,040,287 B2
(45) Date of Patent: Aug. 7, 2018

(54) HEAD UNIT

(71) Applicant: SEIKO EPSON CORPORATION, Tokyo (JP)

(72) Inventor: Motonori Chikamoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/714,061

(22) Filed: Sep. 25, 2017

(65) Prior Publication Data

US 2018/0086074 A1 Mar. 29, 2018

(30) Foreign Application Priority Data

Sep. 29, 2016 (JP) ..... 2016-191123

(51) Int. Cl.
*B41J 2/14* (2006.01)
*B41J 2/045* (2006.01)

(52) U.S. Cl.
CPC ..... *B41J 2/14201* (2013.01); *B41J 2/04521* (2013.01); *B41J 2/1433* (2013.01); *B41J 2/14072* (2013.01); *B41J 2/04581* (2013.01); *B41J 2002/14491* (2013.01)

(58) Field of Classification Search
CPC ..... B41J 2/14201; B41J 2/14072; B41J 2/04521; B41J 2/1433; B41J 2/04581; B41J 2002/14491
See application file for complete search history.

(56) References Cited

U.S. PATENT DOCUMENTS

2005/0219325 A1* 10/2005 Sugahara ..... B41J 2/14233 347/58

FOREIGN PATENT DOCUMENTS

JP 2010-251392 A 11/2010

* cited by examiner

*Primary Examiner* — Geoffrey Mruk

(57) ABSTRACT

Disclosed is a head unit including: a plurality of ejecting units that eject liquids; a driving IC that drives the plurality of ejecting units; a first substrate; a second substrate; a first electrode; and a second electrode, the first electrode electrically connects the first wiring and the third wiring with each other, the second electrode electrically connects the second wiring and the third wiring with each other, the driving IC is overlapped with the first substrate in plan view of the first substrate, and the signal from the second substrate is transmitted from the second substrate in order of the first terminal, the first wiring, the first electrode, the third wiring, the second electrode, and the second wiring.

15 Claims, 13 Drawing Sheets

<DECODING CONTENTS OF DECODER>

| PRINT DATA Data | T1 | | T2 | |
|---|---|---|---|---|
| | Sa | Sb | Sa | Sb |
| (1, 1) | H | L | H | L |
| (0, 1) | H | L | L | H |
| (1, 0) | L | L | L | H |
| (0, 0) | L | H | L | L |

MSB LSB

HEAD UNIT

This application claims priority to Japanese Patent Application No. 2016-191123 filed on Sep. 29, 2016. The entire disclosure of Japanese Patent Application No. 2016-191123 is hereby incorporated herein by reference.

BACKGROUND

1. Technical Field

The present invention relates to a head unit.

2. Related Art

A head unit (liquid ejecting head) which includes a driving IC and a plurality of piezoelectric elements provided correspondingly to each of a plurality of nozzles and ejects liquids from the plurality of nozzles by each of the plurality of piezoelectric elements being driven by a driving signal supplied from the driving IC is known.

In recent years, the head unit is manufactured by Micro Electro Mechanical Systems (MEMS) technology, and along with miniaturization of the head unit, a mounting method in which a driving IC and a substrate are joined by a resin core bump has been developed. In such the mounting method, unless a contact state between the driving IC and the substrate is appropriate, electrical connection between the driving IC and the substrate cannot be secured and an error occurs. For this reason, it is necessary to inspect conduction in a case of connecting the driving IC and the substrate by the resin core bump.

For example, in JP-A-2010-251392, a method in which when an IC chip on which a dummy terminal (dummy bump) is formed is mounted on a substrate, if the dummy terminal is pressed and is brought into contact with a pedestal unit of the substrate, a conductive film of the dummy terminal is divided so as to be in a non-conductive state, a probe (needle) is brought into contact with the conductive film of the dummy terminal, a resistance value is measured, and conduction is inspected based on the measured resistance value is disclosed.

However, in order to realize an inspection method described in JP-A-2010-251392, since it is necessary to form a dummy bump having a configuration different from other bumps on a driving IC, the number of processes is increased and a special device has to be prepared. In addition, in order to form such the dummy bump, since further fine accuracy is required in the MEMS technology, there is a considerably large barrier to use the MEMS technology.

SUMMARY

An advantage of some aspects of the invention is that it provides a head unit capable of efficiently inspecting conduction of a driving IC and a substrate.

The invention can be realized in the following aspects or application examples.

APPLICATION EXAMPLE 1

According to this application example, there is provided a head unit including: a plurality of ejecting units that eject liquids; a driving IC that drives the plurality of ejecting units; a first substrate; a second substrate; a first electrode; and a second electrode, in which the first substrate is a rectangular shape that has a first short side, a first long side, a second short side, and a second long side in plan view, the driving IC is a rectangular shape that has a third short side, a third long side, a fourth short side, and a fourth long side in plan view, on the first substrate, a first wiring extended in a direction from a side of the first short side to the second short side, a second wiring separated from the first wiring and extended in a direction from a side of the second short side to the first short side, and a first terminal to which a signal from the second substrate is input on the side of the first short side are provided, on the driving IC, a third wiring extended in a direction from a side of the third short side to the fourth short side is provided, the first electrode electrically connects the first wiring and the third wiring with each other, the second electrode electrically connects the second wiring and the third wiring with each other, the driving IC is overlapped with the first substrate in plan view of the first substrate, and the signal from the second substrate is transmitted from the second substrate in order of the first terminal, the first wiring, the first electrode, the third wiring, the second electrode, and the second wiring.

The first substrate may be a relay substrate which relays a signal from the driving IC to the substrate on which at least a part of an ejecting unit is formed and may be a substrate itself on which at least a part of the ejecting unit is formed.

In the head unit according to the application example, since a resistance value of the third wiring provided on the driving IC and a resistance value of the first wiring and the second wiring provided on the first substrate are different from each other, by presence or absence of a connection error of the first electrode or the second electrode, a difference occurs in a resistance value of the wiring through which the signal from the second substrate is transmitted. According to the head unit of the application example, after the driving IC is connected to the first substrate, by measuring the resistance value of the wiring through which the signal from the second substrate is transmitted, it is possible to efficiently inspect conduction of the driving IC and the first substrate. The conduction inspection may be performed in an arbitrary process after the drive IC is connected to the first substrate, and it is not necessary to perform the conduction inspection after the head unit according to the application example is completed.

APPLICATION EXAMPLE 2

In the head unit according to the application example, a length of the first long side may be equal to or larger than 10 times a length of the first short side and a length of the third long side may be equal to or larger than 10 times a length of the third short side.

In the head unit according to the application example, since the driving IC is a considerably long elongated chip, the third wiring becomes longer and a difference between a resistance value of the third wiring and a resistance value of each of the first wiring and the second wiring becomes larger. According to the head unit of the application example, by presence or absence of a connection error of the first electrode or the second electrode, since a difference in resistance values of the wiring through which the signal from the second substrate is transmitted becomes larger, it is possible to efficiently and easily inspect conduction of the driving IC and the first substrate.

APPLICATION EXAMPLE 3

In the head unit according to the application example, the first wiring and the second wiring may be provided on the first substrate in a straight line shape.

According to the head unit of the application example, since the first wiring and the second wiring can be disposed to be space-saving on the first substrate, it is possible to miniaturize the first substrate.

APPLICATION EXAMPLE 4

In the head unit according to the application example, a width of the first wiring in a short side direction may be larger than a width of the third wiring in a short side direction in plan view of the first substrate.

In the head unit according to the application example, since the third wiring is thinner than the first wiring, a difference between a resistance value of the third wiring and a resistance value of the first wiring becomes larger. According to the head unit of the application example, by presence or absence of a connection error of the first electrode, since a difference in resistance values of the wiring through which the signal from the second substrate is transmitted becomes larger, it is possible to efficiently and easily inspect conduction of the driving IC and the first substrate.

Further, according to the head unit of the application example, since the first wiring having a width larger than a width of the third wiring functions as a wiring reinforcing the third wiring, it is possible to reduce concern for malfunction of the driving IC.

APPLICATION EXAMPLE 5

In the head unit according to the application example, the third wiring may be overlapped with the first wiring and the second wiring in plan view of the first substrate.

According to the head unit of the application example, since the third wiring provided on the driving IC is overlapped with the first wiring and the second wiring and the first wiring, the first electrode, the second electrode, and the second wiring can be disposed to be space-saving on the first substrate, it is possible to miniaturize the first substrate and it is possible for the first wiring to more effectively function as a wiring reinforcing the third wiring.

APPLICATION EXAMPLE 6

In the head unit according to the application example, on the first wiring, a second terminal may be provided at a position between the first short side and the first electrode and not overlapping with the driving IC in plan view of the first substrate, and on the second wiring, a third terminal may be provided at a position between the second electrode and the second short side and not overlapping with the driving IC in plan view of the first substrate.

According to the head unit of the application example, after the driving IC is connected to the first substrate, since a space above the second terminal and a space above the third terminal are open, it is possible to measure a resistance value between the second terminal and the third terminal and to efficiently inspect conduction of the driving IC and the first substrate by measuring the resistance.

APPLICATION EXAMPLE 7

In the head unit according to the application example, the second terminal and the third terminal may be terminals for inspection.

According to the head unit of the application example, after the driving IC is connected to the first substrate, by bringing each of probes into contact with the second terminal and the third terminal and by an inspection device measuring a resistance value between the second terminal and the third terminal, it is possible to efficiently inspect conduction of the driving IC and the first substrate.

APPLICATION EXAMPLE 8

In the head unit according to the application example, the first electrode and the second electrode may be provided on the first substrate.

According to the head unit of the application example, after the first electrode and the second electrode are provided on the first substrate, before the driving IC is connected to the first substrate, it is possible to inspect conduction of the first electrode or the second electrode and the first substrate.

APPLICATION EXAMPLE 9

In the head unit according to the application example, at least a part of each of the first electrodes and the second electrodes may be provided on a surface of a resin layer extended in a direction from the first short side to the second short side.

According to the head unit of the application example, since it is possible to give elasticity to the first electrode and the second electrode by the resin layer, it is possible to more reliably perform conduction of the driving IC and the first substrate by the first electrode and the second electrode. In addition, since it is possible to produce the first wiring, the first electrode, the second electrode, and the second wiring in a same process, it is easier to manufacture the head unit according to the application example.

APPLICATION EXAMPLE 10

In the head unit according to the application example, the signal from the second substrate may be a power supply voltage signal.

According to the head unit of the application example, after the driving IC is connected to the first substrate, it is possible to efficiently inspect whether or not a power supply voltage signal which is important for the driving IC so as to operate accurately is sufficiently transmitted to the driving IC.

APPLICATION EXAMPLE 11

In the head unit according to the application example, the signal from the second substrate may be a signal that is an original signal for driving each of the plurality of ejecting units.

According to the head unit of the application example, after the driving IC is connected to the first substrate, it is possible to efficiently inspect whether or not a signal which is an original driving signal which greatly affects ejection accuracy by the ejecting unit is sufficiently transmitted to the driving IC.

APPLICATION EXAMPLE 12

In the head unit according to the application example, the head unit may be used for an industrial ink jet printer.

"Industrial ink jet printer" means a printer (manufacturing apparatus) used for manufacturing an Organic Electro-Luminescence (OEL) device, a color filter for a liquid crystal, or the like by a droplet ejecting method. The industrial ink jet printer is mainly used for manufacturing industrial products such as a liquid crystal color filter and an organic electro-luminescence device, and the like and is required to have ejection weight accuracy, enlargement to improve productivity, downsizing for improvement in concentration of finished products (high resolution of an ejecting unit), or the like. For this reason, since density of nozzles is higher and the driving IC becomes longer, a conduction error between the driving IC and the first substrate is likely to occur, or, since the number of the nozzles becomes larger and the number of the driving ICs which are targets of conduction inspection becomes larger, by applying the head unit according to the application example, it is possible to improve yielding percentage and to reduce the number of inspection processes.

APPLICATION EXAMPLE 13

In the head unit according to the application example, the head unit may be used for a textile ink jet printer.

"Textile ink jet printer" means an ink jet printer which performs printing on a fabric or sublimates and transfers an image printed on a medium and performs printing on the fabric. The textile ink jet printer is mainly used for a purpose of producing small quantities of various types and high speed on-demand supply of products, and is used for providing fabrics in accordance with customer needs. For this reason, since density of nozzles is higher and the driving IC becomes longer, a conduction error between the driving IC and the first substrate is likely to occur, or, since the number of the nozzles becomes larger and the number of the driving ICs which are targets of conduction inspection becomes larger, by applying the head unit according to the application example, it is possible to improve yielding percentage and to reduce the number of inspection processes.

APPLICATION EXAMPLE 14

In the head unit according to the application example, the head unit may be used for a label ink jet printer.

"Label ink jet printer" means an ink jet printer which prints a receipt, a product label, a ticket, and the like. The label ink jet printer is mainly used in a supermarket cash register in cooperation with a Point Of Sales (POS) system, an airport counter, a factory which performs printing of a package label of grocery, and the like and is required to print large volumes of data of different format at high speed, to operate stably, and the like. For this reason, since density of nozzles is higher and the driving IC becomes longer, a conduction error between the driving IC and the first substrate is likely to occur, or, since the number of the nozzles becomes larger and the number of the driving ICs which are targets of conduction inspection becomes larger, by applying the head unit according to the application example, it is possible to improve yielding percentage and to reduce the number of inspection processes.

APPLICATION EXAMPLE 15

In the head unit according to the application example, the head unit may be used for a business ink jet printer.

"Business ink jet printer" means an ink jet printer developed and designed on a premise of being used in an office or the like. The business ink jet printer is required to have the same printing speed (specifically, a printing speed of approximately 30 ppm (pages per minute) to 100 ppm) as that of an electrophotographic printing apparatus and to have a higher printing speed than that of a printer supplied for a traditional consumer market. For this reason, since density of nozzles is higher and the driving IC becomes longer, a conduction error between the driving IC and the first substrate is likely to occur, or, since the number of the nozzles becomes larger and the number of the driving ICs which are targets of conduction inspection becomes larger, by applying the head unit according to the application example, it is possible to improve yielding percentage and to reduce the number of inspection processes.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, preferable embodiments of the invention will be described in detail with reference to drawings. The used drawings are for convenience of explanation. The embodiments to be described below do not unfairly limit contents of the invention described in the claims. In addition, all of configurations to be described below are not essential components of the invention.

Hereinafter, a head unit according to the invention will be described by the head unit applied to a liquid ejecting apparatus which is a printing apparatus as an example.

1. Embodiment 1-1. Overall Liquid Ejecting Apparatus

Figure 1:
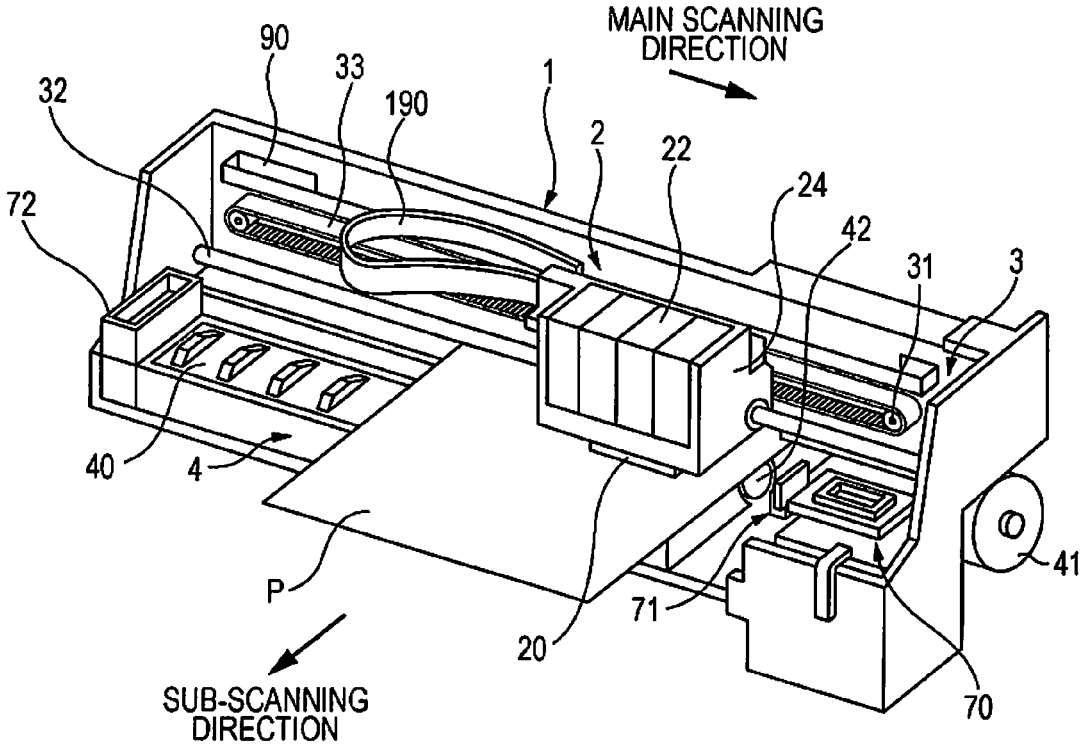
FIG. 1 is a diagram illustrating a schematic configuration of an inside of a liquid ejecting apparatus.

FIG. 1 is a perspective view illustrating a schematic configuration of an inside of a liquid ejecting apparatus 1 (printing apparatus) to which the head unit of the present embodiment is applied. The liquid ejecting apparatus 1 is an ink jet printer which forms an ink dot group on a print medium such as paper by ejecting an ink according to image data supplied from an external host computer and prints an image (including letters, figures, and the like) according to the image data. In FIG. 1, a housing and a cover do not illustrated. As illustrated in FIG. 1, the liquid ejecting apparatus 1 includes a moving mechanism 3 which moves a head unit 2 in a main scanning direction (reciprocating motion).

The moving mechanism 3 has a carriage motor 31 which is a driving source of the head unit 2, a carriage guide shaft 32 of which both of ends are fixed, and a timing belt 33 which is expanded approximately in parallel with the carriage guide shaft 32 and is driven by the carriage motor 31.

The carriage 24 of the head unit 2 is configured to be able to mount a predetermined number of ink cartridges 22. For example, four cartridges 22 corresponding to four colors of yellow, cyan, magenta, and black are mounted on the carriage 24 and an ink of a color corresponding to each of the ink cartridges 22 is filled in the ink cartridge 22.

The carriage 24 is supported by the carriage guide shaft 32 to be freely reciprocated and is fixed to a part of the timing belt 33. For this reason, if the timing belt 33 is run in forward and reverse directions by the carriage motor 31, the head unit 2 is reciprocated while being guided by the carriage guide shaft 32. In this way, the carriage motor 31 is a motor which moves the carriage 24 in the main scanning direction (first direction).

In addition, the moving mechanism 3 includes a linear encoder 90 which detects a position of the head unit 2 in the main scanning direction. The position of the head unit 2 in the main scanning direction is detected by the linear encoder 90.

In addition, a head 20 (recording head) is provided on a portion of the head unit 2 facing a print medium P. As described below, the head 20 is a liquid ejecting head for ejecting ink drops (droplets) from a plurality of nozzles, and various control signals and the like are supplied to the head unit 2 via a flexible cable 190.

The liquid ejecting apparatus 1 includes a transport mechanism 4 which transports the print medium P on a platen 40 in a sub-scanning direction. The transport mechanism 4 includes a transport motor 41 which is a driving source and a transport roller 42 which is rotated by the transport motor 41 and transports the print medium P in the sub-scanning direction.

At a timing when the print medium P is transported by the transport mechanism 4, an image is formed on a surface of the print medium P by the head 20 ejecting an ink drop onto the print medium P.

A home position which is a base point of scanning of the head unit 2 is set to an end region within a movement range of the head unit 2. In the home position, a capping member 70 which seals a nozzle forming surface of the head 20 and a wiper member 71 which wipes the nozzle forming surface are disposed. The liquid ejecting apparatus 1 forms an image on a surface of the print medium P in both directions when the head unit 2 forward moves from the home position to an end on an opposite side and the head unit 2 backward returns from the end on the opposite side to the home position side.

A flushing box 72 which collects ink drops ejected from the head 20 when flushing operation is disposed in an end of the platen 40 in the main scanning direction. The flushing operation is operation of forcibly ejecting an ink from each of nozzles regardless of image data to be printed so as to prevent an appropriate amount of the ink from not being ejected by clogging the nozzle and bubbles entering into the nozzles due to thickening of the ink in a periphery of the nozzles. In detail, in a region (ink ejection region) other than a region in which an ink drop is ejected on the print medium P in the platen 40, in more detail, a region other than an outside than the ink ejection region in the main scanning direction, the flushing box 72 is disposed at a position which is an outside than an end of the print medium P in a width direction (maximum recording width) when the print medium P having a maximum size allowed by the liquid ejecting apparatus 1 is disposed on the platen 40. Although it is preferable that the flushing boxes 72 be provided on both sides of the platen 40 in the main scanning direction, the flushing box 72 may be provided at least on one side.

The head unit 2 moves above the print medium P or the flushing box 72 and performs operation of ejecting an ink drop toward the print medium P and flushing operation of ejecting an ink drop toward the flushing box 72.

1-2. Electrical Configuration of Liquid Ejecting Apparatus

Figure 2:
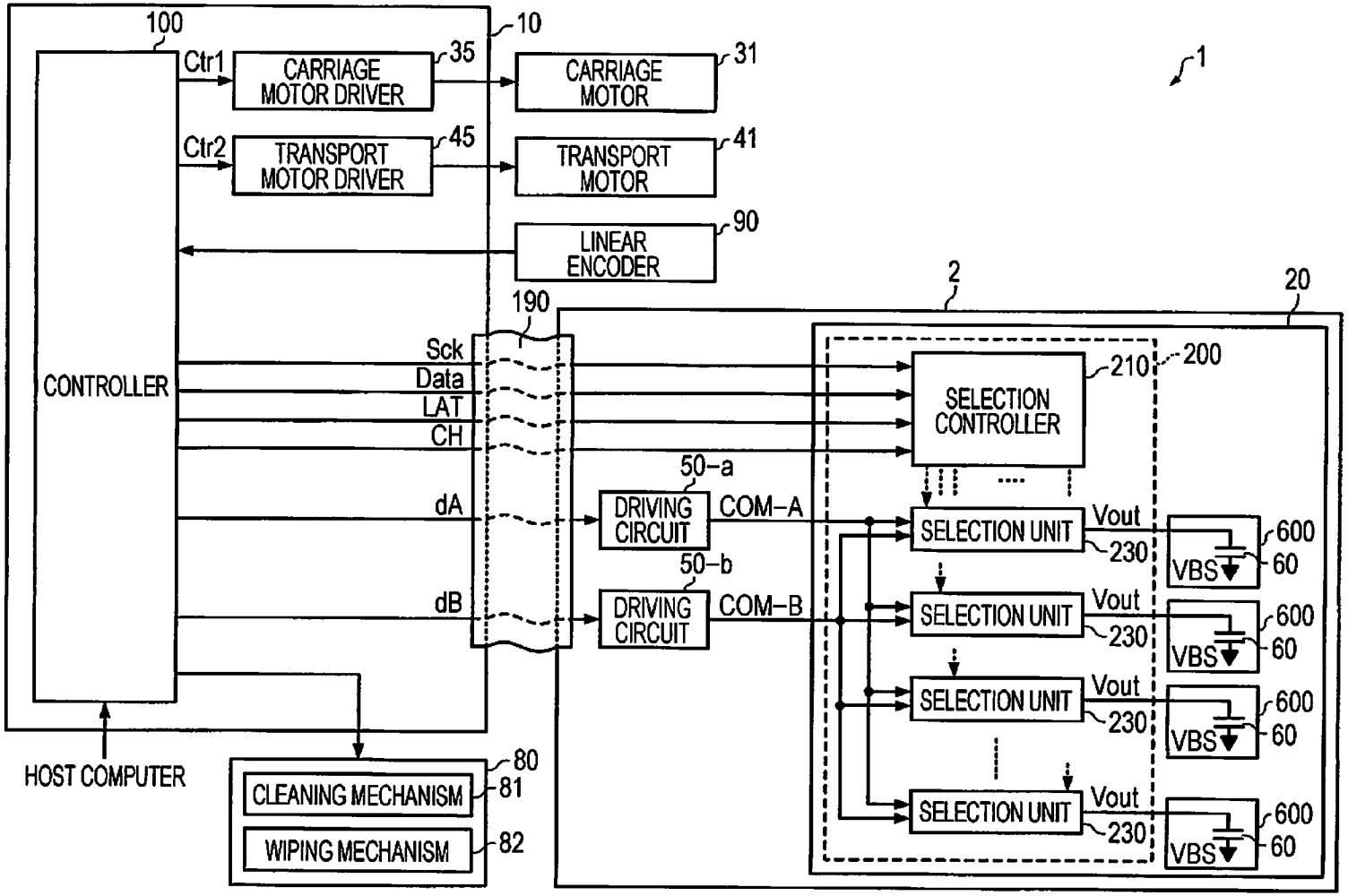
FIG. 2 is a block diagram illustrating an electrical configuration of the liquid ejecting apparatus.

FIG. 2 is a block diagram illustrating an electrical configuration of the liquid ejecting apparatus 1. As illustrated in FIG. 2, a control unit 10 and the head unit 2 are connected to the liquid ejecting apparatus 1 via the flexible cable 190.

The control unit 10 has a controller 100, a carriage motor driver 35, and a transport motor driver 45. Among the controller 100, the carriage motor driver 35, and the transport motor driver 45, the controller 100 outputs various control signals and the like for control of each of units when image data is supplied from a host computer.

In detail, the controller 100 recognizes a scanning position (current position) of the head unit 2 based on a detection signal (encoder pulse) of the linear encoder 90. Then, based on the scanning position of the head unit 2, the controller 100 supplies a control signal Ctr1 to the carriage motor driver 35 and the carriage motor driver 35 drives the carriage motor 31 according to the control signal Ctr1. Accordingly, a movement of the carriage 24 in the main scanning direction is controlled.

In addition, the controller 100 supplies a control signal Ctr2 to the transport motor driver 45 and the transport motor driver 45 drives the transport motor 41 according to the control signal Ctr2. Accordingly, a movement of the transport mechanism 4 in the sub-scanning direction is controlled.

In addition, the controller 100 supplies a clock signal Sck, a data signal Data, control signals LAT and CH, and digital data dA and dB to the head unit 2.

In addition, the controller 100 causes a maintenance unit 80 to execute a maintenance process of restoring an ejecting state of an ink in an ejecting unit 600 to a normal state. As the maintenance process, the maintenance unit 80 may have a cleaning mechanism 81 for performing a cleaning process (pumping process) in which an ink, a bubble, and the like thickened inside the ejecting unit 600 are sucked by a tube pump (not illustrated). In addition, as the maintenance process, the maintenance unit 80 may have a wiping mechanism 82 for performing a wiping process in which foreign matters such as paper dust and the like adhering to a periphery of a nozzle of the ejecting unit 600 are wiped off by the wiper member 71.

The head unit 2 has driving circuits 50-*a* and 50-*b* and the head 20. In addition, the head 20 includes a plurality of ejecting units 600 which eject a liquid and a driving IC 200 which drives the plurality of ejecting units 600. The driving IC 200 includes a selection controller 210 and a plurality of selection units 230. In FIG. 2, only one driving IC 200 is illustrated, but the head unit 2 may have a plurality of driving ICs 200 which drive the plurality of ejecting units 600 different from each other. Hereinafter, for simplicity of explanation, it is assumed that there is only one driving IC 200, but the following description can be easily expanded even in a case of the plurality of driving ICs 200.

After the driving circuit 50-*a* performs digital/analog conversion on the data dA, the driving circuit 50-*a* generates a driving signal COM-A by Class D amplification and supplies the driving signal COM-A to each of the selection units 230. In the same manner, after the driving circuit 50-*b* performs digital/analog conversion on the data dB, the driving circuit 50-*b* generates a driving signal COM-B by Class D amplification and supplies the driving signal COM-B to each of the selection units 230. Here, the data dA defines a waveform of the driving signal COM-A and the data dB defines a waveform of the driving signal COM-B. Since input data and an output driving signal are different only, the driving circuits 50-*a* and 50-*b* may have the same circuit configuration.

The selection controller 210 instructs selection of one of the driving signals COM-A and COM-B for each of the selection units 230 (or non-selection) by the clock signal Sck, the data signal Data, and the control signals LAT and CH supplied from the controller 100.

Each of the selection units 230 selects the driving signal COM-A or COM-B according to an instruction from the selection controller 210 and supplies the selected driving signal COM-A or COM-B to one end of each of piezoelectric elements 60 included in the head 20. In FIG. 2, a voltage of the driving signal is denoted by Vout. A voltage VBS is supplied to the other end of each of the piezoelectric elements 60 in common.

The piezoelectric element 60 is displaced by applying the driving signal. The piezoelectric element 60 is provided in accordance with each of the plurality of ejecting units 600 in the head 20. Then, the piezoelectric element 60 is displaced according to a difference between the driving signal voltage Vout selected by the selection unit 230 and the voltage VBS and ejects an ink. In this way, the driving signals COM-A or COM-B is an original signal of a driving signal (a driving signal selected by the selection unit 230) which drives each of the plurality of ejecting units 600.

Figure 3:
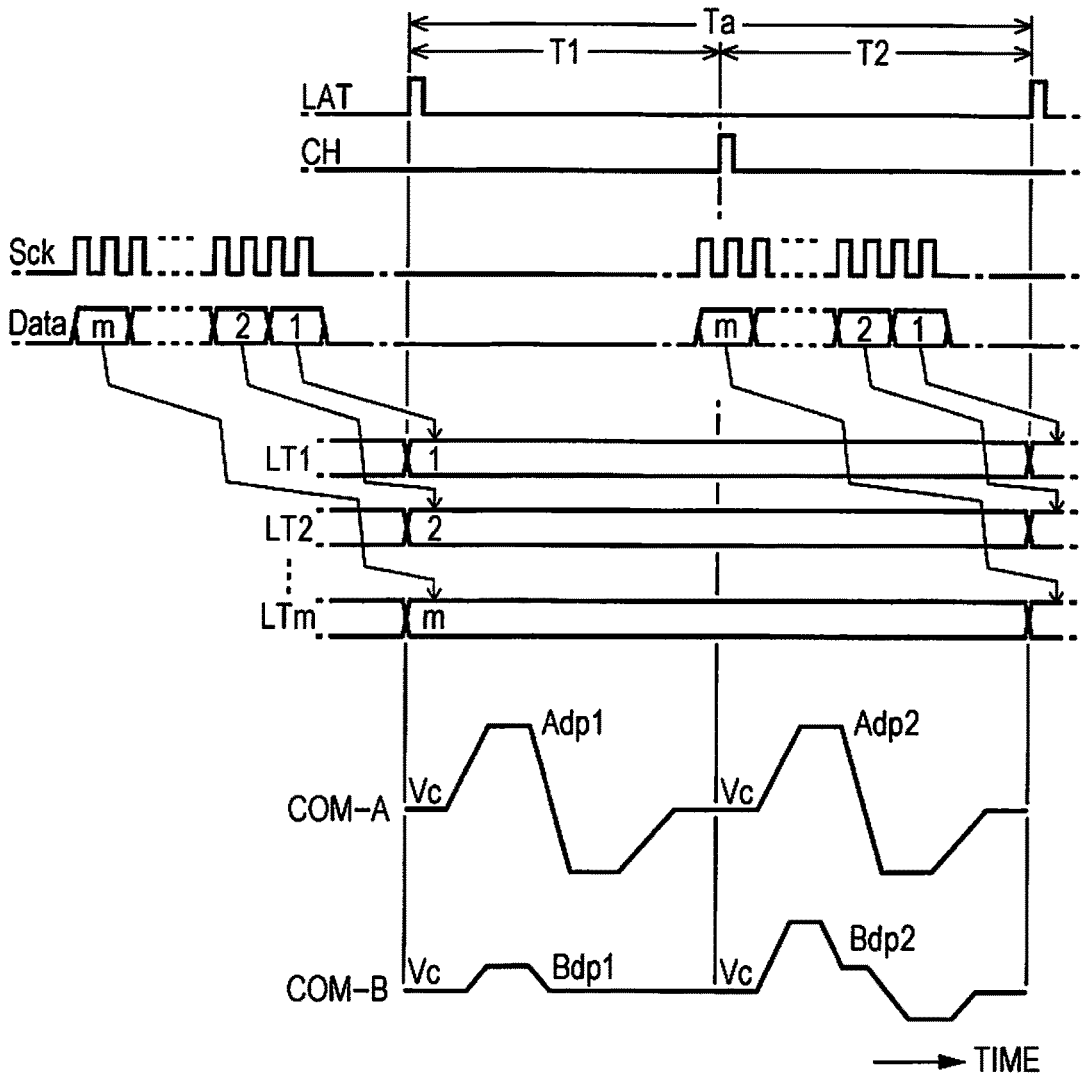
FIG. 3 is a diagram for explaining operation of a selection controller in a head unit.

FIG. 3 is a diagram illustrating waveforms and the like of the driving signals COM-A and COM-B. As illustrated in FIG. 3, the driving signal COM-A is a waveform obtained by continuing a trapezoidal waveform Adp1 disposed in a period of time T1 from an output (rising) of the control signal LAT to an output of the control signal CH within a print cycle Ta and a trapezoidal waveform Adp2 disposed in a period of time T2 from an output of the control signal CH to an output of the next control signal LAT within a print cycle Ta.

In the present embodiment, the trapezoidal waveforms Adp1 and Adp2 are approximately equal to each other. If each of the trapezoidal waveforms Adp1 and Adp2 is supplied to one end of the piezoelectric element 60, the trapezoidal waveforms Adp1 and Adp2 are waveforms in which a nozzle corresponding to each of the piezoelectric elements 60 ejects a predetermined amount, specifically, a moderate amount of ink.

The driving signal COM-B is a waveform obtained by continuing a trapezoidal waveform Bdp1 disposed in the period of time T1 and a trapezoidal waveform Bdp2 disposed in the period of time T2. In the present embodiment, the trapezoidal waveforms Bdp1 and Bdp2 are different from each other. Among the trapezoidal waveforms Bdp1 and Bdp2, the trapezoidal waveform Bdp1 is a wave for preventing an ink in a periphery of an opening portion of a nozzle from being thickened by slightly vibrating the ink. For this reason, even if the trapezoidal waveform Bdp1 is supplied to one end of the piezoelectric element 60, an ink drop is not ejected from the nozzle corresponding to the piezoelectric element 60. In addition, the trapezoidal waveform Bdp2 is a waveform different from the trapezoidal waveform Adp1 (Adp2). If the trapezoidal waveform Bdp2 is supplied to one end of the piezoelectric element 60, the trapezoidal waveform Bdp2 is a waveform when an amount of ink smaller than the predetermined amount is ejected from the nozzle corresponding to the piezoelectric element 60.

A voltage of the trapezoidal waveforms Adp1, Adp2, Bdp1, and Bdp2 at start timing and a voltage at end timing are voltages Vc in common. That is, each of the trapezoidal waveforms Adp1, Adp2, Bdp1, and Bdp2 is a waveform which starts at the voltage Vc and ends at the voltage Vc.

Figure 4:
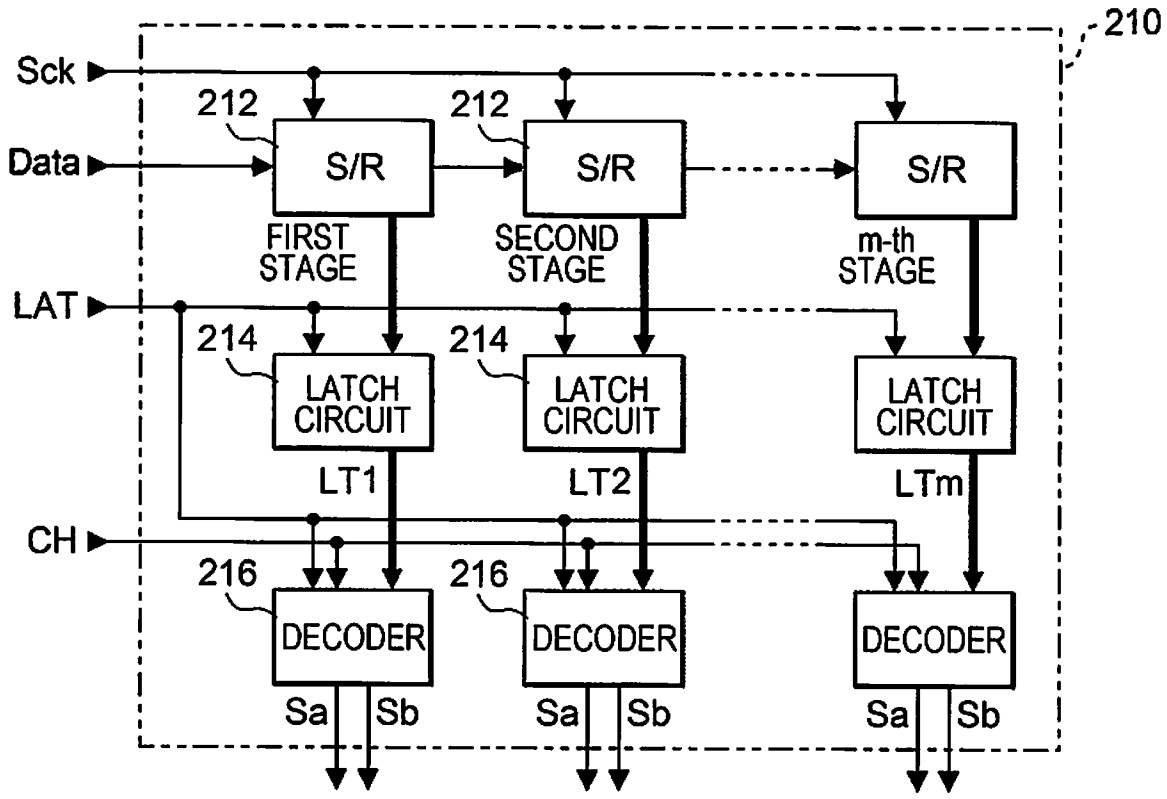
FIG. 4 is a diagram illustrating a configuration of the selection controller in the head unit.

FIG. 4 is a diagram illustrating a configuration of the selection controller 210 in FIG. 2. As illustrated in FIG. 4, the clock signal Sck, the data signal Data, and the control signals LAT and CH are supplied from the control unit 10 to the selection controller 210. A set of a shift register (S/R) 212, a latch circuit 214, and a decoder 216 is provided corresponding to each of the piezoelectric elements 60 (nozzles) in the selection controller 210.

In forming one dot of an image, the data signal Data defines a size of the dot. In the present embodiment, in order to express 4 gradations of non-record, a small dot, a medium dot, and a large dot, the data signal Data is configured to include 2 bits of an upper bit (MSB) and a lower bit (LSB).

The data signal Data is supplied in serial from the controller 100 to each of nozzles in accordance with main scanning of the head unit 2 in synchronization with the clock signal Sck. The shift register 212 is configured to temporarily hold the data signal Data supplied in serial for 2 bits corresponding to the nozzle.

In detail, the shift registers 212 having the number of stages corresponding to the piezoelectric elements 60 (nozzles) are cascade-connected to each other, and the data signal Data supplied in serial is transferred to a sequentially next stage according to the clock signal Sck.

When it is assumed that the number of the piezoelectric elements 60 is m (m is plural), in order to distinguish the shift registers 212, it is sequentially denoted as first stage, second stage, . . . , m-th stage from an upstream side to which the data signal Data is supplied.

The latch circuit 214 latches the data signal Data held by the shift register 212 at a rising edge of the control signal LAT.

The decoder 216 decodes the data signal Data of 2 bits latched by the latch circuit 214, outputs selection signals Sa and Sb, and defines selection of the selection unit 230 for each of the periods of time T1 and T2 defined by the control signal LAT and the control signal CH.

Figures 5, 6:
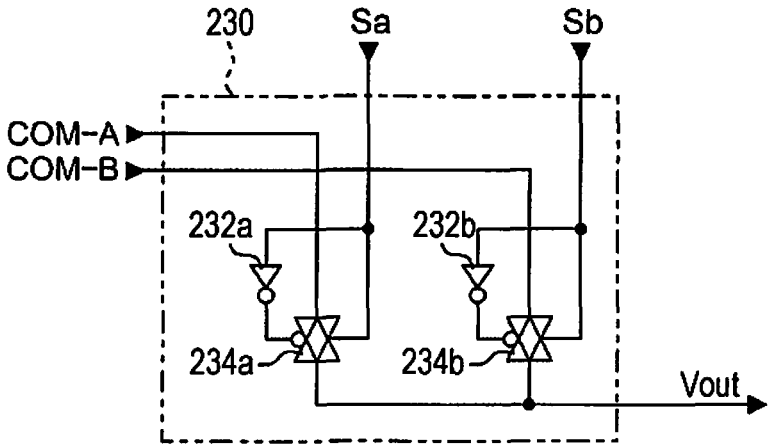
FIG. 5 is a diagram illustrating decoding contents of a decoder in the head unit.
FIG. 6 is a diagram illustrating a configuration of a selection unit in the head unit.

FIG. 5 is a diagram illustrating decoding contents in the decoder 216. In FIG. 5, the latched data signal Data of 2-bit is denoted as MSB and LSB. For example, when the data signal Data is (0, 1), the decoder 216 respectively outputs H and L levels in the period of time T1 and respectively outputs L and H levels in the period of time T2 as logical levels of the selection signals Sa and Sb.

The logical levels of the selection signals Sa and Sb are level-shifted to high amplitude logic than logic levels of the clock signal Sck, the data signal Data, the control signals LAT and CH by a level shifter (not illustrated).

FIG. 6 is a diagram illustrating a configuration of the selection unit 230 corresponding to one piezoelectric element 60 (nozzle) in FIG. 2.

As illustrated in FIG. 6, the selection unit 230 has inverters (not circuits) 232*a* and 232*b* and transfer gates 234*a* and 234*b*.

While the selection signal Sa from the decoder 216 is supplied to a positive control end, to which a circle is not attached, in the transfer gate 234*a*, the selection signal Sa is logically inverted by the inverter 232*a* and is supplied to a negative control end, to which a circle is attached, in the transfer gate 234*a*. In the same manner, while the selection signal Sb is supplied to a positive control end in the transfer gate 234*b*, the selection signal Sb is logically inverted by the inverter 232*b* and is supplied to a negative control end in the transfer gate 234*b*.

The driving signal COM-A is supplied to an input end of the transfer gate 234*a* and the driving signal COM-B is supplied to an input end of the transfer gate 234*b*. An output end of the transfer gate 234*a* and an output end of the transfer gate 234*b* are connected in common and are connected to one end of the corresponding piezoelectric element 60.

When the selection signal Sa is an H level, the transfer gate 234*a* conducts (ON) between the input end and the output end and when the selection signal Sa is an L level, the transfer gate 234*a* non-conducts (OFF) between the input end and the output end. In the same manner, the transfer gate 234*b* turns on and off between the input end and the output end according to the selection signal Sb.

Next, operation of the selection controller 210 and the selection unit 230 will be described with reference to FIG. 3.

The data signal Data is supplied in serial from the controller 100 to each of nozzles in synchronization with the clock signal Sck and is sequentially transferred by the shift register 212 corresponding to the nozzle. Then, if the controller 100 stops to supply the clock signal Sck, each of the shift registers 212 is in a state in which the data signal Data corresponding to the nozzle is held. The data signal Data is supplied in order of the last m-th stage, . . . , second stage, and first stage corresponding to nozzles in the shift registers 212.

Here, when the control signal LAT rises, each of the latch circuits 214 simultaneously latch the data signal Data held by the shift register 212. In FIG. 3, LT1, LT2, . . . , LTm illustrate that the data signal Data is latched by the latch circuits 214 corresponding to the shift registers 212 of first stage, second stage, . . . , m-th stage.

The decoder 216 outputs logical levels of the selection signals Sa and Sb in each of the periods of time T1 and T2 as contents illustrated in FIG. 5 according to a size of a dot defined by the latched data signal Data.

That is, in a case where the data signal Data is (1, 1) and a size of a large dot is defined, the decoder 216 sets the selection signals Sa and Sb to H and L levels in the period of time T1 and sets the selection signals Sa and Sb to H and L levels in the period of time T2. In addition, in a case where the data signal Data is (0, 1) and a size of a medium dot is defined, the decoder 216 sets the selection signals Sa and Sb to H and L levels in the period of time T1 and sets the selection signals Sa and Sb to L and H levels in the period of time T2. Further, in a case where the data signal Data is (1, 0) and a size of a small dot is defined, the decoder 216 sets the selection signals Sa and Sb to L and L levels in the period of time T1 and sets the selection signals Sa and Sb to L and H levels in the period of time T2. In addition, in a case where the data signal Data is (0, 0) and non-record is defined, the decoder 216 sets the selection signals Sa and Sb to L and H levels in the period of time T1 and sets the selection signals Sa and Sb to L and L levels in the period of time T2.

Figure 7:
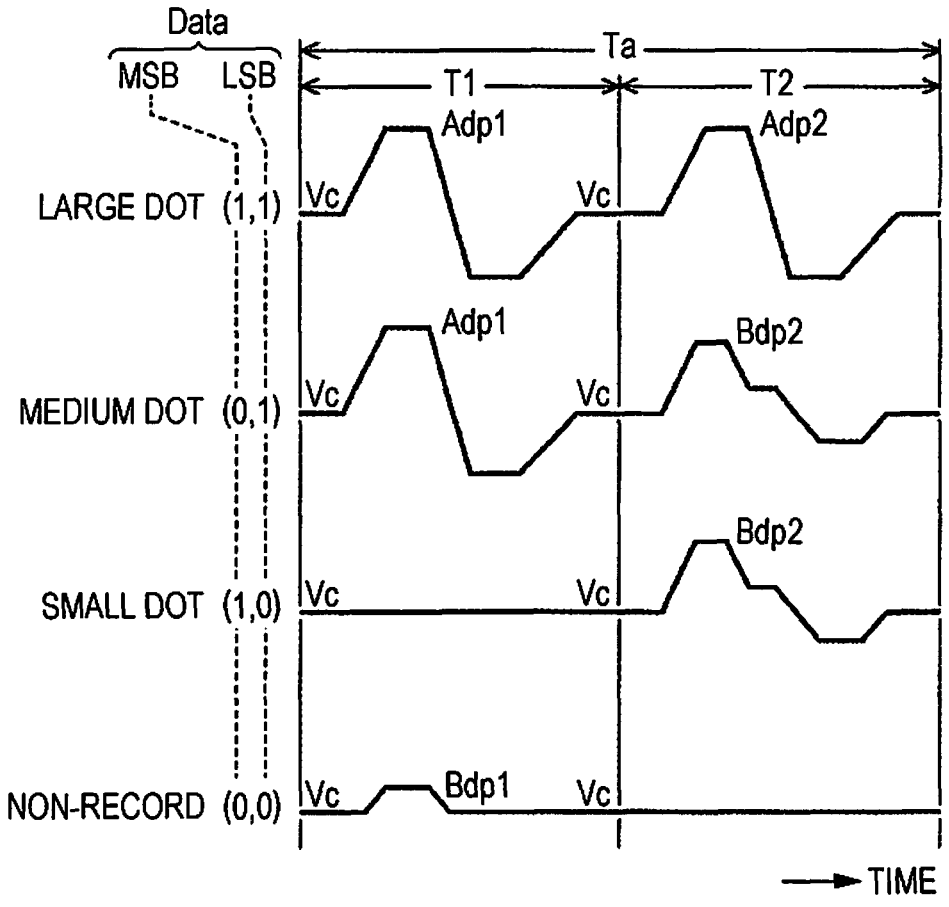
FIG. 7 is a diagram illustrating a driving signal selected by the selection unit.

FIG. 7 is a diagram illustrating a voltage waveform of a driving signal selected according to the data signal Data and supplied to one end of the piezoelectric element 60.

When the data signal Data is (1, 1), the selection signals Sa and Sb become H and L levels in the period of time T1, so that the transfer gate 234*a* is turned on and the transfer gate 234*b* is turned off. For this reason, the trapezoidal waveform Adp1 of the driving signal COM-A is selected in the period of time T1. Since the selection signals Sa and Sb become H and L levels in the period of time T2, the selection unit 230 selects the trapezoidal waveform Adp2 of the driving signal COM-A.

In this way, when the trapezoidal waveform Adp1 is selected and supplied to one end of the piezoelectric element 60 as a driving signal in the period of time T1, and the trapezoidal waveform Adp2 is selected and supplied to one end of the piezoelectric element 60 as the driving signal in the period of time T2, a moderate amount of ink is ejected two times from a nozzle corresponding to the piezoelectric element 60. For this reason, inks are respective landed on the print medium P and combined, and as a result, a large dot as defined by the data signal Data is formed.

When the data signal Data is (0, 1), the selection signals Sa and Sb become H and L levels in the period of time T1, so that the transfer gate 234*a* is turned on and the transfer gate 234*b* is turned off. For this reason, the trapezoidal waveform Adp1 of the driving signal COM-A is selected in the period of time T1. Next, since the selection signals Sa and Sb become L and H levels in the period of time T2, the trapezoidal waveform Bdp2 of the driving signal COM-B is selected.

Accordingly, a moderate amount of ink and a small amount of ink are ejected two times from a nozzle. For this reason, inks are respective landed on the print medium P and combined, and as a result, a medium dot as defined by the data signal Data is formed.

When the data signal Data is (1, 0), the selection signals Sa and Sb become L and L levels in the period of time T1, so that the transfer gate 234*a* is turned off and the transfer gate 234*b* is turned off. For this reason, none of the trapezoidal waveforms Adp1 and Bdp1 is selected in the period of time T1. In a case where the transfer gates 234*a* and 234*b* are both turned off, a path from a connection point between the output ends of the transfer gates 234*a* and 234*b* to one end of the piezoelectric element 60 is in a high impedance state in which none of portions is electrically connected. However, the piezoelectric element 60 holds a voltage (Vc-VBS) immediately before the transfer gates 234*a* and 234*b* are turned off by capacitive property of the piezoelectric element 60.

Next, since the selection signals Sa and Sb become L and H levels in the period of time T2, the trapezoidal waveform Bdp2 of the driving signal COM-B is selected. For this reason, since only a small amount of ink is ejected from the nozzle in the period of time T2, a small dot as defined by the data signal Data is formed on the print medium P.

When the data signal Data is (0, 0), the selection signals Sa and Sb become L and H levels in the period of time T1, so that the transfer gate 234*a* is turned off and the transfer gate 234*b* is turned on. For this reason, the trapezoidal waveform Bdp1 of the driving signal COM-B is selected in the period of time T1. Next, since the selection signals Sa and Sb become L and L levels in the period of time T2, none of the trapezoidal waveforms Adp2 and Bdp2 is selected.

For this reason, since an ink in a periphery of an opening portion of the nozzle vibrates only slightly in the period of time T1 and the ink is not ejected, as a result, a dot is not formed, that is, non-record is performed as defined by the data signal Data.

In this way, the selection unit 230 selects the driving signals COM-A or COM-B (or does not select) according to an instruction by the selection controller 210 and supplies the selected driving signals COM-A or COM-B to one end of the piezoelectric element 60. For this reason, each of the piezoelectric elements 60 is driven according to a size of a dot defined by the data signal Data.

The driving signals COM-A and COM-B illustrated in FIG. 3 are merely examples. Actually, various combinations of waveforms prepared in advance are used according to a moving speed of the head unit 2, properties of the print medium P, and the like.

1-3. Internal Configuration of Head

Figure 8:
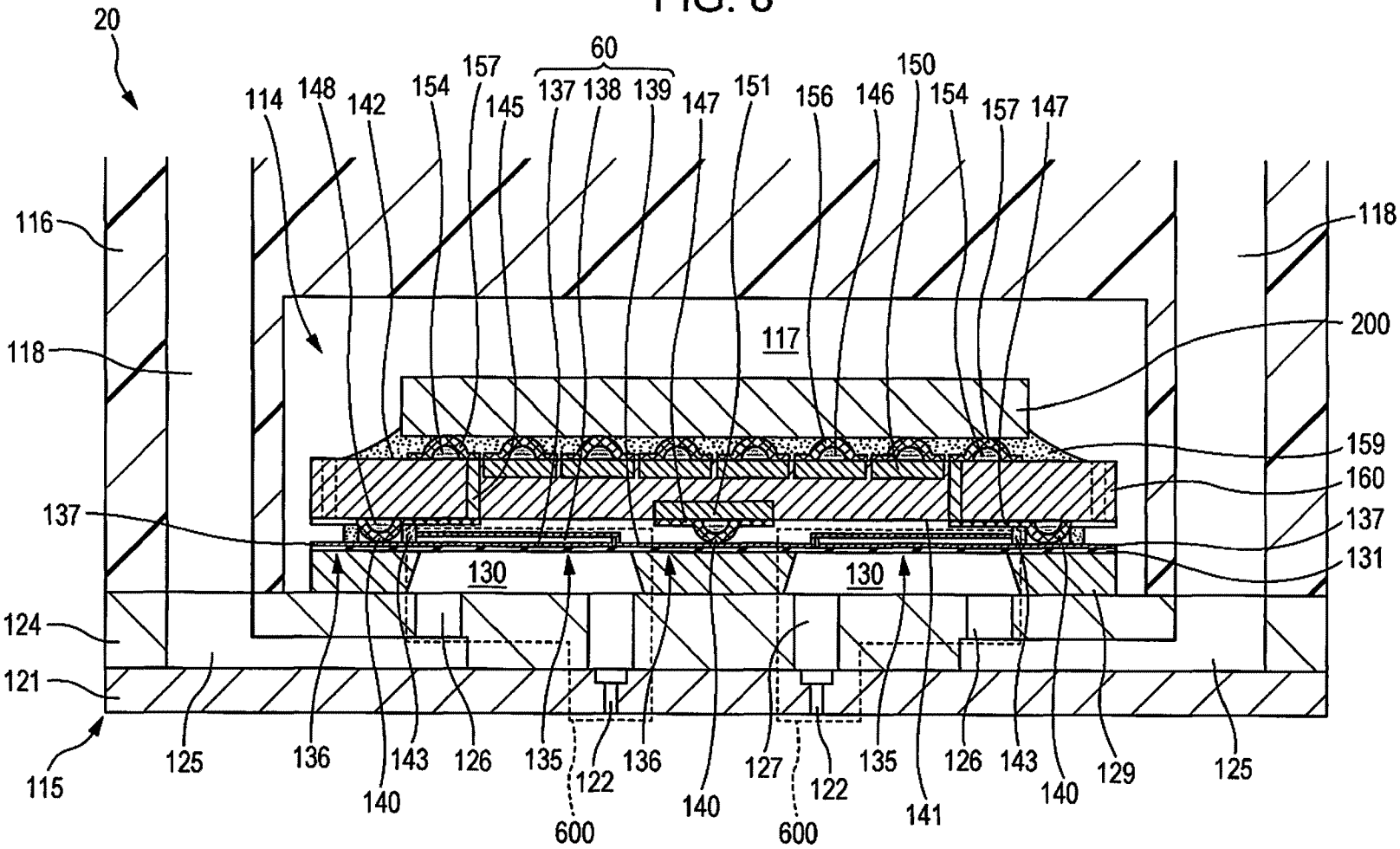
FIG. 8 is a cross-sectional view for explaining an internal configuration of a head.

FIG. 8 is a cross-sectional view for explaining an internal configuration of the head 20. In FIG. 8, right and left direction is a main scanning direction. As illustrated in FIG. 8, the head 20 of the present embodiment is attached to a head case 116 in a state in which an electronic device 114 and a flow path unit 115 are stacked. For convenience, a stacking direction of each of members will be described as an up-down direction.

A reservoir 118 which supplies an ink to each of pressure chambers (cavities) 130 is formed inside the head case 116. The reservoir 118 is a space in which an ink common to a plurality of juxtaposed pressure chambers 130 is stored and two reservoirs 118 are formed corresponding to rows of the pressure chambers 130 juxtaposed in two rows. An ink introduction path (not illustrated) for introducing an ink from an ink cartridge 22 side into the reservoir 118 is formed above the head case 116. In addition, an accommodating space 117 in which the electronic device 114 (driving IC 200, pressure chamber forming substrate 129, sealing plate 160, and the like) stacked on a communication substrate 124 is accommodated is formed on a lower surface side of the head case 116.

The flow path unit 115 has the communication substrate 124 and a nozzle plate 121. A common liquid chamber 125 which communicates with the reservoir 118 and stores an ink common to each of the pressure chambers 130 and an individual communication path 126 which individually supplies the ink from the reservoir 118 to each of the pressure chambers 130 via the common liquid chamber 125 are formed on the communication substrate 124. The common liquid chamber 125 is an elongated empty portion along a nozzle row direction and two rows of the common liquid chambers 125 are formed corresponding to rows of the pressure chambers 130 juxtaposed in two rows. The individual communication paths 126 are plurally formed along a juxtapositional direction of the pressure chamber 130 in accordance with the pressure chamber 130 in a thin plate portion of the common liquid chamber 125. The individual communication path 126 communicates with an end of one side of the corresponding pressure chamber 130 in a longitudinal direction in a state in which the communication substrate 124 and the pressure chamber forming substrate 129 are joined.

In addition, a nozzle communication path 127 penetrating through the communication substrate 124 in a substrate thickness direction is formed at a position corresponding to each of nozzles 122 of the communication substrate 124. That is, the nozzle communication paths 127 are plurally formed along the nozzle row direction corresponding to nozzle rows. By the nozzle communication path 127, the pressure chamber 130 communicates with the nozzle 122. The nozzle communication path 127 communicates with an end of the other side (opposite side of individual communication path 126) of the corresponding pressure chamber 130 in a longitudinal direction in a state in which the communication substrate 124 and the pressure chamber forming substrate 129 are joined.

The nozzle plate 121 is a substrate joined to a lower surface (a surface opposite to the pressure chamber forming substrate 129) of the communication substrate 124. By the nozzle plate 121, an opening on a lower surface side of a space which is the common liquid chamber 125 is sealed. In addition, in the nozzle plate 121, a plurality of nozzles 122 are formed linearly (in a row shape) and two rows of the nozzles 122 are formed corresponding to rows of the pressure chambers 130 formed in two rows. The plurality of juxtaposed nozzles 122 (nozzle rows) are provided at a pitch (for example, 600 dpi) corresponding to dot formation density from one end side of the nozzle 122 to the other end side of the nozzle 122 and at an interval along the sub-scanning direction orthogonal to the main scanning direction.

The electronic device 114 is a thin plate type device which functions as an actuator for generating pressure fluctuation in an ink in each of the pressure chambers 130. In the electronic device 114, the pressure chamber forming substrate 129, a diaphragm 131, the piezoelectric element 60, the sealing plate 160, and the driving IC 200 are stacked to form a unit.

In the pressure chamber forming substrate 129, spaces to be the pressure chambers 130 are plurally juxtaposed along the nozzle row direction. The space, of which a lower side is partitioned by the communication substrate 124 and an upper side is partitioned by the diaphragm 131, constitutes the pressure chamber 130. The pressure chambers 130 are formed in two rows corresponding to rows of the nozzles formed in two rows. Each of the pressure chambers 130 is an elongated empty portion in a direction orthogonal to the nozzle row direction and the individual communication path 126 communicates with an end of one side of the pressure chamber 130 in a longitudinal direction and the nozzle communication path 127 communicates with an end of the other side of the pressure chamber 130.

The diaphragm 131 is a thin film type member having elasticity and is stacked on an upper surface (a surface opposite to a communication substrate 124 side) of the pressure chamber forming substrate 129. By the diaphragm 131, an upper opening of a space to be the pressure chamber 130 is sealed. A portion of the diaphragm 131 corresponding to an upper opening of the pressure chamber 130 functions as a displacement unit which is displaced in a direction away from or close to the nozzle 122 in accordance with flexure deformation of the piezoelectric element 60. That is, a region of the diaphragm 131 corresponding to the upper opening of the pressure chamber 130 is a driving region 135 in which flexure deformation is allowed. On the other hand, a region deviated from the upper opening of the pressure chamber 130 in the diaphragm 131 is a non-driving region 136 in which flexure deformation is inhibited.

Each of the piezoelectric elements 60 are stacked on the driving region 135. The piezoelectric elements 60 are formed along the nozzle row direction in two rows corresponding to the pressure chambers 130 juxtaposed along the nozzle row direction in two rows. For example, the piezoelectric element 60 includes a lower electrode layer 137 (individual electrode), a piezoelectric layer 138, and an upper electrode layer 139 (common electrode) sequentially stacked on the diaphragm 131. If an electric field is applied according to a potential difference of both electrodes between the lower electrode layer 137 and the upper electrode layer 139, the piezoelectric element 60 having such the configuration is deformed to be bent in a direction away from or close to the nozzle 122. An end on the other side (an outside of the piezoelectric element 60 in a longitudinal direction) of the lower electrode layer 137 extends beyond the region in which the piezoelectric layer 138 is stacked from the driving region 135, to the non-driving region 136. On the other hand, an end on one side (an inside of the piezoelectric element 60 in the longitudinal direction) of the upper electrode layer 139 extends beyond the region in which the piezoelectric layer 138 is stacked from the driving region 135, to the non-driving region 136 between rows of the piezoelectric elements 60.

The sealing plate 160 is a flat plate type substrate disposed with a space from the diaphragm 131 (or the piezoelectric element 60). The driving IC 200 driving the piezoelectric element 60 is disposed on a second surface 142 (upper surface) on an opposite side of a first surface 141 (lower surface) which is a surface on a diaphragm 131 side of the sealing plate 160. That is, the diaphragm 131 in which the piezoelectric element 60 is stacked is connected to the first surface 141 of the sealing plate 160 and the driving IC 200 is connected to the second surface 142.

A plurality of bump electrodes 140 which output a driving signal from the driving IC 200 to a piezoelectric element 60 side are formed on the first surface 141 of the sealing plate 160. The bump electrodes 140 are plurally formed respectively along a nozzle row direction at a position corresponding to one side of the lower electrode layer 137 (individual electrode) extended to an outside of one side of the piezoelectric element 60, at a position corresponding to the other side of the lower electrode layer 137 (individual electrode) extended to an outside of the other side of the piezoelectric element 60, and at a position corresponding to the upper electrode layer 139 (common electrode) common to a plurality of the piezoelectric elements 60 formed between rows of both side of the piezoelectric element 60. Then, each of the bump electrodes 140 is connected to the corresponding lower electrode layer 137 and upper electrode layer 139.

At least a part of the bump electrode 140 is provided on a surface of a resin layer 148 having elasticity. The resin layer 148 is formed as a ridge along the nozzle row direction on the first surface 141 of the sealing plate 160. The bump electrodes 140 conducted to the lower electrode layer 137 (individual electrode) are plurally formed along a nozzle row direction corresponding to the piezoelectric element 60 juxtaposed along the nozzle row direction. Each of the bump electrodes 140 is extended from above the resin layer 148 to a piezoelectric element 60 side or a side opposite to the piezoelectric element 60 side to become a lower surface side wiring 147. Then, an end on a side opposite to the bump electrode 140 of the lower surface side wiring 147 is connected to a through-wiring 145.

The bump electrodes 140 corresponding to the upper electrode layer 139 are plurally formed on a lower surface side embedded wiring 151 embedded in the first surface 141 of the sealing plate 160, along a nozzle row direction. Then, the bump electrode 140 protrudes from above the resin layer 148 to both sides of the resin layer 148 in a width direction to form the lower surface side wiring 147 and is formed to conduct with the lower surface side embedded wiring 151. The bump electrodes 140 are plurally formed along a nozzle row direction.

The sealing plate 160 and the pressure chamber forming substrate 129 are joined by a photosensitive adhesive 143 in a state in which the bump electrode 140 is interposed therebetween. The photosensitive adhesive 143 is formed on both sides of each of the bump electrodes 140 in a direction orthogonal to a nozzle row direction. In addition, each of the photosensitive adhesives 143 is formed in a band shape along a nozzle row direction in a state of being separated from the bump electrode 140.

A plurality of upper surface side embedded wirings 150 extended in a nozzle row direction are formed on the second surface 142 of the sealing plate 160. Various power supply voltage signals, the driving signals COM-A and COM-B, and the like are supplied from a flexible printed substrate (not illustrated in FIG. 8) (a printed circuit substrate 180 illustrated in FIGS. 9 to 10 described below) to the upper surface side embedded wiring 150. A plurality of bump electrodes 156 are formed on each of the upper surface side embedded wirings 150 in a nozzle row direction. At least a part of the bump electrode 156 is provided on a surface of a resin layer 146 having elasticity. The resin layer 146 is formed as a ridge along the nozzle row direction on the second surface 142 of the sealing plate 160. Each of the bump electrodes 156 conducts with a wiring (not illustrated) inside of the driving IC 200 via a terminal (not illustrated) of the driving IC 200.

Further, bump electrodes 157 to which an output signal (driving signal) from the driving IC 200 is input are formed on regions on both end sides in the second surface 142 of the sealing plate 160. At least a part of the bump electrode 157 is provided on a surface of a resin layer 154 having elasticity. The resin layer 154 is formed as a ridge along the nozzle row direction on the second surface 142 of the sealing plate 160. The bump electrode 157 is connected to the corresponding lower surface side wiring 147 via the through-wiring 145.

The through-wiring 145 is a wiring which relays between the first surface 141 and the second surface 142 of the sealing plate 160. By the through-wiring 145, the bump electrode 157 is electrically connected to the lower surface side wiring 147 extended from the bump electrode 140 corresponding to the electrode 153 and a driving signal is transmitted from the driving IC 200 to the pressure chamber forming substrate 129. In this way, the sealing plate 160 functions as a relay substrate which relays a driving signal from the driving IC 200 to the pressure chamber forming substrate 129.

The driving IC 200 is an IC chip for driving the piezoelectric element 60 and is stacked on the second surface 142 of the sealing plate 160 via an adhesive 159. Input terminals (not illustrated) respectively connected to the bump electrodes 156 are plurally formed on a surface on a sealing plate 160 side of the driving IC 200 and a signal (various power supply voltage signals, the driving signals COM-A and COM-B, or the like) is transmitted from the upper surface side embedded wiring 150 provided on the sealing plate 160 to each of the input terminals via the bump electrode 156. In addition, output terminals (not illustrated) respectively connected to the bump electrodes 157 are plurally formed on a surface on the sealing plate 160 side of the driving IC 200 and a signal (individual driving signal for driving each of the piezoelectric elements 60) from each of the output terminals is transmitted to each of the bump electrodes 157.

The driving IC 200 is a considerably long elongated chip in a nozzle row direction, and each of signals transmitted to each of the input terminals is transmitted through a wiring with a small thickness and width and considerably long length in an inside of the driving IC 200 and is supplied to each of the selection units 230 (see FIG. 2) which outputs an individual driving signal for driving each of the piezoelectric elements 60. For this reason, a resistance value between both ends of each of internal wirings of the driving IC 200 is considerably large and each of signals transmitted through each of the internal wirings is attenuated (voltage level decreases) under influence of voltage drop due to the wiring resistance, as a result, the signal becomes lower for the selection unit 230 close to an end. Therefore, in the present embodiment, the upper surface side embedded wiring 150 of which a thickness and a width are sufficiently larger than the internal wiring of the driving IC 200 is also used as a reinforcement wiring of each of the internal wirings of the driving IC 200. That is, each of the upper surface side embedded wirings 150 is provided in parallel with each of the internal wirings of the driving IC 200, and each of signals is transmitted to each of input terminals of the driving IC 200 via each of the upper surface side embedded wirings 150 and the plurality of bump electrodes 156 formed on each of the upper surface side embedded wirings 150 along a nozzle row direction. Accordingly, voltage drop of each of the signals supplied to each of the selection units 230 is reduced, and the selection unit 230 close to an end of the driving IC 200 is also less likely to perform malfunction.

The bump electrodes 157 are formed in two rows on both sides of the bump electrode 156 corresponding to rows of the piezoelectric element 60 juxtaposed in two rows, and in the rows of the bump electrodes 157, a distance (that is, a pitch) (a pitch of the output terminals of the driving IC 200) between centers of the bump electrodes 157 adjacent to each other is formed to be smaller than a pitch of the bump electrodes 140 (a pitch of the nozzles 122). That is, the sealing plate 160 also absorbs a difference between the pitch of the output terminals of the driving IC 200 and the pitch of the nozzles 122, accordingly, it is possible to miniaturize the driving IC 200.

The head 20 formed as described above introduces an ink from the ink cartridge 22 to the pressure chamber 130 via an ink introduction path, the reservoir 118, the common liquid chamber 125, and the individual communication path 126. In this state, by supplying a driving signal from the driving IC 200 to the piezoelectric element 60 via each of wirings formed on the sealing plate 160, the piezoelectric element 60 is driven to cause pressure fluctuation in the pressure chamber 130. By using the pressure fluctuation, the head 20 ejects an ink drop from the nozzle 122 via the nozzle communication path 127.

The ejecting unit 600 is configured to include the piezoelectric element 60, the diaphragm 131, the pressure chamber 130, the individual communication path 126, the nozzle communication path 127, and the nozzle 122 (see FIG. 2).

1-4. Conduction Inspection Method of Driving IC and Sealing Plate

As described above, in order for the upper surface side embedded wiring 150 to function as a reinforcement wiring of the internal wiring of the driving IC 200, it is necessary for the plurality of bump electrodes 156 respectively formed on the upper surface side embedded wiring 150 to be properly contacted with each of the input terminals of the driving IC 200. For this reason, although conduction inspection between each of the bump electrodes 156 and each input terminal of the driving ICs 200 is necessary, since after the driving IC 200 is connected to the sealing plate 160, there is hardly any gap between the driving IC 200 and the sealing plate 160, it is not possible to perform conduction inspection by bringing a probe into contact with each of the bump electrodes 156. Further, since the driving IC 200 is an elongated chip and the internal wiring is thin and long, a resistance value between both of ends of the driving IC 200 becomes considerably larger and a resistance value of each of the upper surface side embedded wirings 150 becomes extremely smaller. Accordingly, even if contact at each of the bump electrodes 156 is not appropriate, since a resistance value between both of ends of each of the upper surface side embedded wirings 150 hardly changes, conduction inspection by measuring the resistance value is also not effective.

Figure 9:
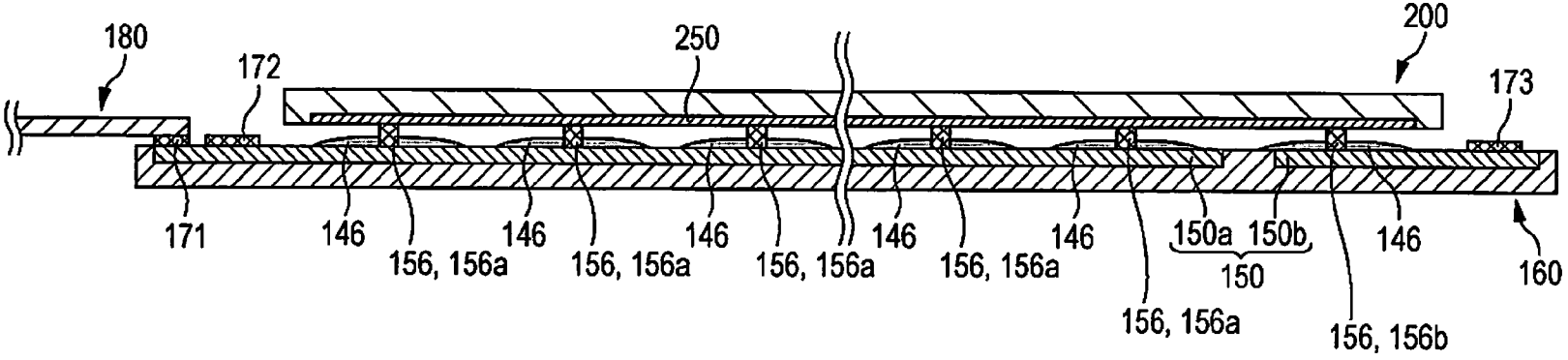
FIG. 9 is a cross-sectional view of a driving IC and a sealing plate.
Figure 10:
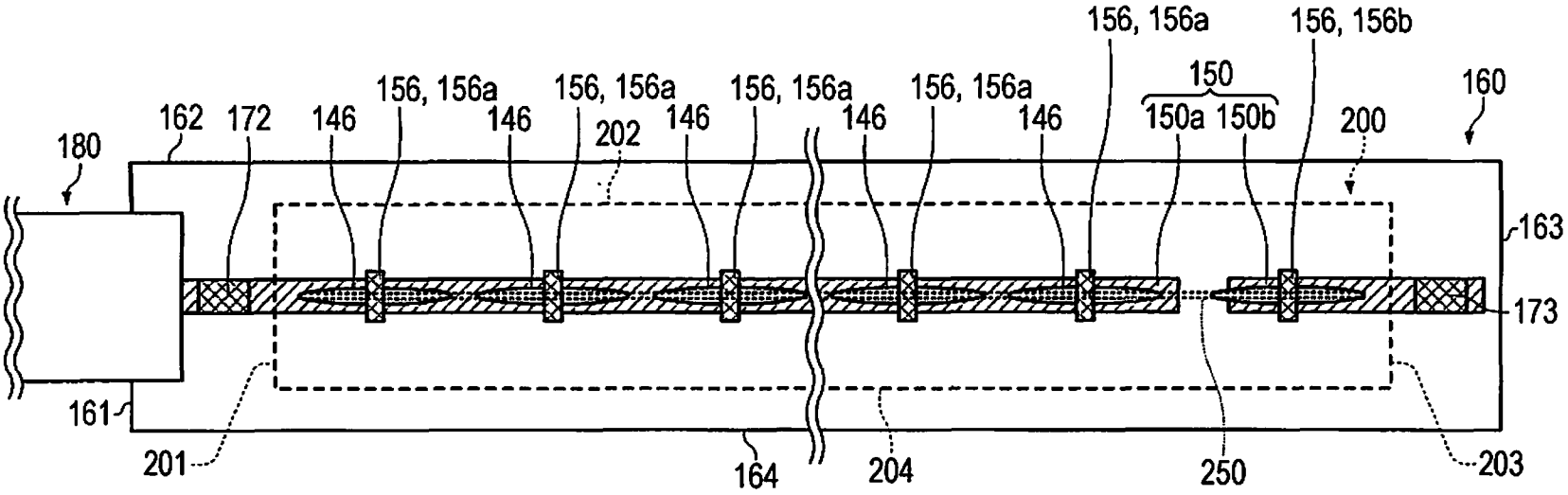
FIG. 10 is a plan view of the driving IC and the sealing plate.

Therefore, in the present embodiment, in consideration of conduction inspection after the driving IC 200 is connected to the sealing plate 160, disposition of the upper surface side embedded wiring 150 and the bump electrode 156 is devised, and the disposition will be described below in detail with reference to FIGS. 9 and 10. FIG. 9 is a cross-sectional view (as viewed from a long side direction of the sealing plate 160) of the driving IC 200 and the sealing plate 160 and FIG. 10 is a plan view (as viewed from an upper surface of FIG. 9) of the driving IC 200 and the sealing plate 160. In FIG. 10, the driving IC 200 is indicated by a broken line. In addition, in FIGS. 9 and 10, only arbitrary one of the plurality of upper surface side embedded wirings 150 illustrated in FIG. 8 is illustrated as a representative, but another upper surface side embedded wiring 150 may have the same configuration.

As illustrated in FIGS. 9 and 10, in plan view, the sealing plate 160 (an example of "first substrate") may be a rectangular shape having a short side 161 (an example of "first short side"), a long side 162 (an example of "first long side"), a short side 163 (an example of "second short side"), and a long side 164 (an example of "second long side"). The sealing plate 160 may be an elongated substrate in which a length of the long side 162 is equal to or more than 10 times a length of the short side 161. In addition, in plan view, the driving IC 200 may be a rectangular shape having a short side 201 (an example of "third short side"), a long side 202 (an example of "third long side"), a short side 203 (an example of "fourth short side" or "first short side"), and a long side 204 (an example of "fourth long side"). The driving IC 200 may be an elongated chip in which a length of the long side 202 is equal to or more than 10 times a length of the short side 201. As illustrated in FIG. 10, in plan view of the sealing plate 160, the driving IC 200 is overlapped with the sealing plate 160.

An upper surface side embedded wiring 150*a* (an example of "first wiring") extended in a direction from a short side 161 side to the short side 163 and an upper surface side embedded wiring 150*b* (an example of "second wiring") separated from the upper surface side embedded wiring 150*a* and extended in a direction from a short side 163 side to the short side 161 are provided on the sealing plate 160. On the sealing plate 160, the upper surface side embedded wiring 150*a* and the upper surface side embedded wiring 150*b* may be provided in a straight line shape. The upper surface side embedded wiring 150 is configured to include the upper surface side embedded wiring 150*a* and the upper surface side embedded wiring 150*b*. In addition, on the sealing plate 160, an input terminal 171 (an example of "first terminal") (input terminal) to which an signal is input from the printed circuit substrate 180 (an example of "second substrate") may be provided on the short side 161 side.

An internal wiring of IC 250 (an example of "third wiring") extended in a direction from a short side 201 side to the short side 203 is provided on the driving IC 200. As illustrated in FIG. 10, in plan view of the sealing plate 160, the internal wiring of IC 250 may be overlapped with the upper surface side embedded wiring 150*a* and the upper surface side embedded wiring 150*b*.

The bump electrode 156 (156*a*) (an example of "first electrode") is electrically connected to the upper surface side embedded wiring 150*a* and the internal wiring of IC 250. In addition, the bump electrode 156 (156*b*) (an example of "second electrode") is electrically connected to the upper surface side embedded wiring 150*b* and the internal wiring of IC 250.

At least a part of each of bump electrodes 156*a* and each of bump electrodes 156*b* is provided on a surface of the resin layer 146 extended in a direction from the short side 161 of the sealing plate 160 to the short side 163. In the present embodiment, the resin layer 146 is formed on the sealing plate 160, and the bump electrode 156*a* and the bump electrode 156*b* are provided on the sealing plate 160.

In this way, in a configuration in which the sealing plate 160 is connected to the driving IC 200 via the bump electrode 156*a* and the bump electrode 156*b*, a signal from the printed circuit substrate 180 is transmitted from the printed circuit substrate 180 in order of the input terminal 171, the upper surface side embedded wiring 150*a*, the bump electrode 156*a*, the internal wiring of IC 250, the bump electrode 156*b*, and the upper surface side embedded wiring 150*b*. The signal from the printed circuit substrate 180 is one of various power supply voltage signals, the driving signals COM-A and COM-B, and the like.

As illustrated in FIG. 9, a thickness of the upper surface side embedded wiring 150*a* is larger than a thickness of the internal wiring of IC 250. In the same manner, a thickness of the upper surface side embedded wiring 150*b* is larger than a thickness of the internal wiring of IC 250. In addition, as illustrated in FIG. 10, in plan view of the sealing plate 160, a width of the upper surface side embedded wiring 150*a* in a short side direction is larger than a width of the internal wiring of IC 250 in a short side direction. In the same manner, a width of the upper surface side embedded wiring 150*b* in a short side direction is larger than a width of the internal wiring of IC 250 in a short side direction. That is, a resistance value between both of ends of the upper surface side embedded wiring 150*a* and a resistance value between both of ends of the upper surface side embedded wiring 150*b* become sufficiently smaller than a resistance value of the internal wiring of IC 250, and the upper surface side embedded wiring 150*a* and the upper surface side embedded wiring 150*b* function as reinforcement wirings reinforcing the internal wiring of IC 250.

In addition, in plan view of the sealing plate 160, on the upper surface side embedded wiring 150*a*, an inspection terminal 172 (an example of "second terminal") may be provided at a position between the short side 161 and the bump electrode 156*a* and not overlapping with the driving IC 200. Further, in plan view of the sealing plate 160, on the upper surface side embedded wiring 150, an inspection terminal 173 (an example of "third terminal") may be provided at a position between the bump electrode 156*b* and the short side 163 and not overlapping with the driving IC 200. Since spaces above the two inspection terminals 172 and 173 is open, after each of the bump electrodes 156 is connected to each of input terminals of the driving IC 200, it is possible to bring a probe into contact with the two inspection terminals 172 and 173. In the present embodiment, it is possible to execute conduction inspection by measuring a resistance value of wiring between the two inspection terminals 172 and 173.

Figure 11:
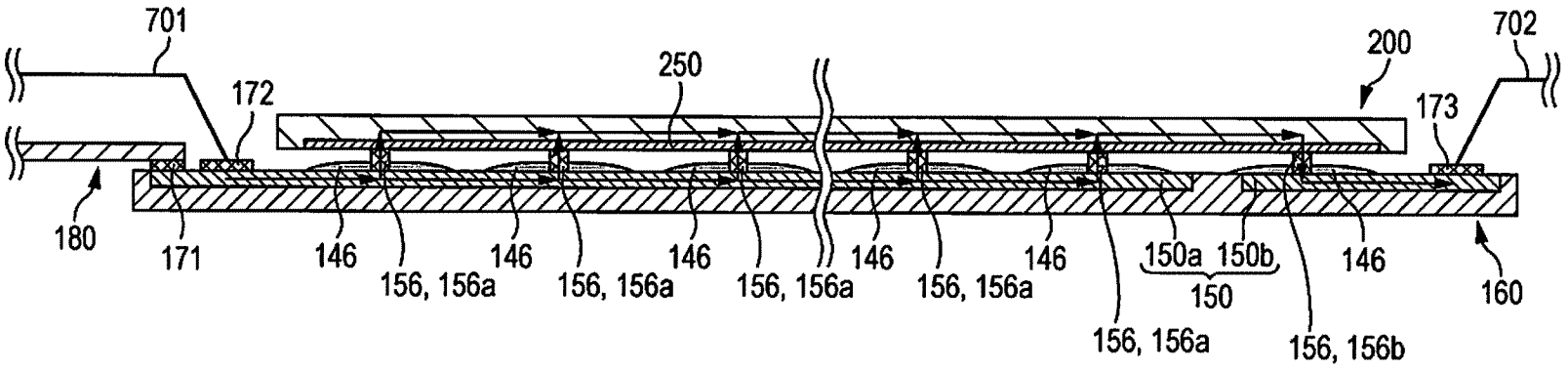
FIG. 11 is a diagram illustrating a form of conduction inspection (probe inspection).
Figure 12:
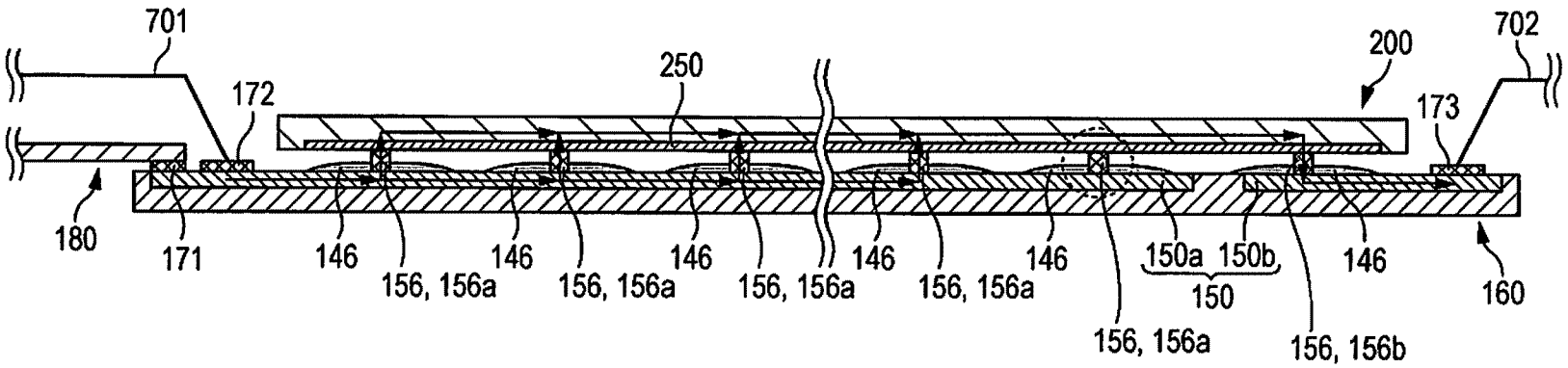
FIG. 12 is a diagram illustrating a form of conduction inspection (probe inspection).

FIGS. 11 and 12 are diagrams illustrating forms of conduction inspection (probe inspection) of the driving IC. In an example of FIG. 11, all of the bump electrode 156*a* and the internal wiring of IC 250 formed on the upper surface side embedded wiring 150*a* are conducted with each other, and the bump electrode 156*b* and the internal wiring of IC 250 formed on the upper surface side embedded wiring 150*b* are conducted with each other. Accordingly, since a current flows from a probe 701 in contact with the inspection terminal 172 to a probe 702 in contact with the inspection terminal 173 through a wiring path indicated by an arrow, the measured resistance value (a wiring resistance value between the inspection terminal 172 and the inspection terminal 173) is approximately equal to a sum of a resistance value of the upper surface side embedded wiring 150*a* and a resistance value of the upper surface side embedded wiring 150.

On the other hand, in an example of FIG. 12, among the bump electrodes 156*a* formed on the upper surface side embedded wiring 150*a*, the bump electrode 156*a* surrounded by a broken line is not conducted with the internal wiring of IC 250. Accordingly, since a current flows from the probe 701 in contact with the inspection terminal 172 to the probe 702 in contact with the inspection terminal 173 through a wiring path indicated by an arrow, a current through a part of the upper surface side embedded wiring 150*a* does not flow and a large amount of current flows through the internal wiring of IC 250. Since the driving IC 200 is an elongated chip and the internal wiring of IC 250 is thin and long, a resistance value becomes larger and the measured resistance value specifically becomes larger as compared with the example in FIG. 11. In the same manner as a case where another bump electrode 156*a* or another bump electrode 156*b* and the internal wiring of IC 250 are not conducted with each other, the measured resistance value is specifically increased.

Accordingly, when the measured resistance value is smaller than a desired threshold value, an inspection device determines that all of the bump electrodes 156 (156*a* and 156*b*) are conducted with the internal wiring of IC 250. When the measured resistance value is larger than a desired threshold value, the inspection device determines that at least a part of the bump electrode 156 (156*a* and 156*b*) is not conducted with the internal wiring of IC 250.

1-5. Operational Effect

As described above, in the head unit 2 of the present embodiment, a resistance value of the internal wiring of IC 250 provided on the driving IC 200 and a resistance value of the upper surface side embedded wiring 150*a* and the upper surface side embedded wiring 150*b* provided on the sealing plate 160 are different from each other. Specifically, if the driving IC 200 is a considerably long elongated chip, the internal wiring of IC 250 becomes thinner and longer. Since a difference between the resistance value of the internal wiring of IC 250 and the resistance value of the upper surface side embedded wiring 150*a* and the upper surface side embedded wiring 150*b* becomes larger, a difference in wiring resistance values between the inspection terminal 172 and the inspection terminal 173 becomes larger according to presence or absence of a connection error of the bump electrode 156*a* or the bump electrode 156*b*. Accordingly, after the driving IC 200 is connected to the sealing plate 160, by measuring a wiring resistance value between the inspection terminal 172 and the inspection terminal 173, it is possible to efficiently inspect conduction of the driving IC 200 and the sealing plate 160. Accordingly, for example, after the driving IC 200 is connected to the sealing plate 160, it is possible to efficiently inspect whether or not a power supply voltage signal which is important for the driving IC 200 so as to operate accurately and the driving signals COM-A and COM-B which greatly affects ejection accuracy by the ejecting unit 600 are sufficiently transmitted to the driving IC 200.

In addition, according to the head unit 2 of the present embodiment, since it is possible to perform conduction inspection between the driving IC 200 and the sealing plate 160 by the upper surface side embedded wiring 150 which functions as a reinforcement wiring of the internal wiring of IC 250 being separated from the two upper surface side embedded wirings 150*a* and 150*b*, it is possible to miniaturize the sealing plate 160 without providing a wiring exclusively for inspection. In order to reduce voltage drop at an end of the internal wiring of IC 250 as much as possible and to reduce possibility that the driving IC 200 malfunctions, as illustrated in FIGS. 9 and 10, it is preferable that the upper surface side embedded wiring 150 is divided between the two bump electrodes 156 furthest from the input terminal 171 on the upper surface side embedded wiring 150.

In addition, according to the head unit 2 of the present embodiment, in plan view of the sealing plate 160, since the internal wiring of IC 250 provided on the driving IC 200 is overlapped with the upper surface side embedded wiring 150*a* and the upper surface side embedded wiring 150*b* and the upper surface side embedded wiring 150*a*, the bump electrode 156*a*, the bump electrode 156*b*, and the upper surface side embedded wiring 150*b* can be disposed to be space-saving on the sealing plate 160, it is possible to miniaturize the sealing plate 160 and it is possible for the upper surface side embedded wiring 150*a* and the upper surface side embedded wiring 150*b* to more effectively function as a reinforcement wiring of the internal wiring of IC 250.

In addition, according to the head unit 2 of the present embodiment, since at least a part of each of the bump electrodes 156*a* and 156*b* is provided on a surface of the resin layer 146, it is possible to give elasticity to the bump electrodes 156*a* and 156*b* and to more reliably perform conduction of the driving IC 200 and the sealing plate 160 by the bump electrodes 156*a* and 156*b*. Further, since it is possible to produce the upper surface side embedded wirings 150*a* and 150*b* and the bump electrodes 156*a* and 156*b* in a same process, it is easier to manufacture the head unit 2.

In the liquid ejecting apparatus 1 (ink jet printer) required to have high speed printing and high accuracy printing, since density of nozzles is higher (the driving IC 200 becomes longer), a conduction error in the head unit 2 is likely to occur, or, since the number of the nozzles becomes larger and the number of the driving ICs 200 becomes larger, by applying the head unit 2 of the present embodiment, it is possible to improve yielding percentage and to reduce the number of inspection processes. For example, the head unit 2 may be used for a business ink jet printer developed and designed on a premise of being used in an office or the like. The business ink jet printer is required to have a printing speed (specifically, a printing speed of approximately 30 ppm (pages per minute) to 100 ppm) as an electrophotographic printing apparatus and to have a high printing speed than a printer supplied for a traditional consumer market. In addition, the business ink jet printer is required to have high durability and maintainability which can be repaired even if the business ink jet printer breaks down so as to be able to endure hard use in the office.

2. Modification Example

In the embodiment described above, the upper surface side embedded wiring 150 is divided into one upper surface side embedded wiring 150*a* and one upper surface side embedded wiring 150*b*, but the upper surface side embedded wiring 150 may be divided into a plurality of wirings.

In addition, in the embodiment described above, as a signal transmitted through the upper surface side embedded wiring 150 (reinforcement wiring), a power supply voltage signal or the driving signals COM-A and COM-B is used, but the signal transmitted through the upper surface side embedded wiring 150 (reinforcement wiring) is not limited thereto. Another signal transmitted through the long internal wiring of IC 250, for example, the clock signal Sck may be used.

In addition, in the embodiment described above, although the resin layers 148 and 154, and the bump electrodes 156 and 157 are provided on the sealing plate 160, it is not absolutely necessary to be provided on the sealing plate 160 and the resin layers 148 and 154, and the bump electrodes 156 and 157 may be provided on the driving IC 200.

In addition, in the embodiment described above, although as a relay substrate which relays a driving signal from the driving IC 200 to the pressure chamber forming substrate 129, the sealing plate 160 is used, it is not absolutely necessary to use the relay substrate and the driving IC 200 may be configured to be directly connected to the pressure chamber forming substrate 129. In such a case, the invention may be applied to a case where the upper surface side embedded wiring 150 (150*a* and 150*b*) is provided on the pressure chamber forming substrate 129 (an example of "first substrate"). In this case, the resin layers 148 and 154, and the bump electrodes 156 and 157 may be provided on the driving IC 200 or on the pressure chamber forming substrate 129.

In addition, in the embodiment described above, although the driving circuits 50-*a* and 50-*b* are provided in the head unit 2, the driving circuits 50-*a* and 50-*b* may be provided in the control unit 10.

3. Application Example

In the embodiment and the modification example described above, the liquid ejecting apparatus 1 is a print only machine, but the liquid ejecting apparatus 1 may be a multi-function printer including a copy function and a scanner function.

In addition, in the embodiment and the modification example described above, the liquid ejecting apparatus 1 is a fixed type device, but the liquid ejecting apparatus 1 may be a portable type device.

In addition, in the embodiment described above, as an example of the liquid ejecting apparatus 1 used for the head unit 2, the business ink jet printer is used, but the liquid ejecting apparatus 1 may be another ink jet printer required to have high speed printing and high accuracy printing.

For example, the head unit 2 may be used for a textile ink jet printer which performs printing on a fabric or sublimates and transfers an image printed on a medium and performs printing on the fabric. The textile ink jet printer is mainly used for a purpose of producing small quantities of various types and high speed on-demand supply of products, and is used for providing fabrics in accordance with customer needs.

Figure 13:
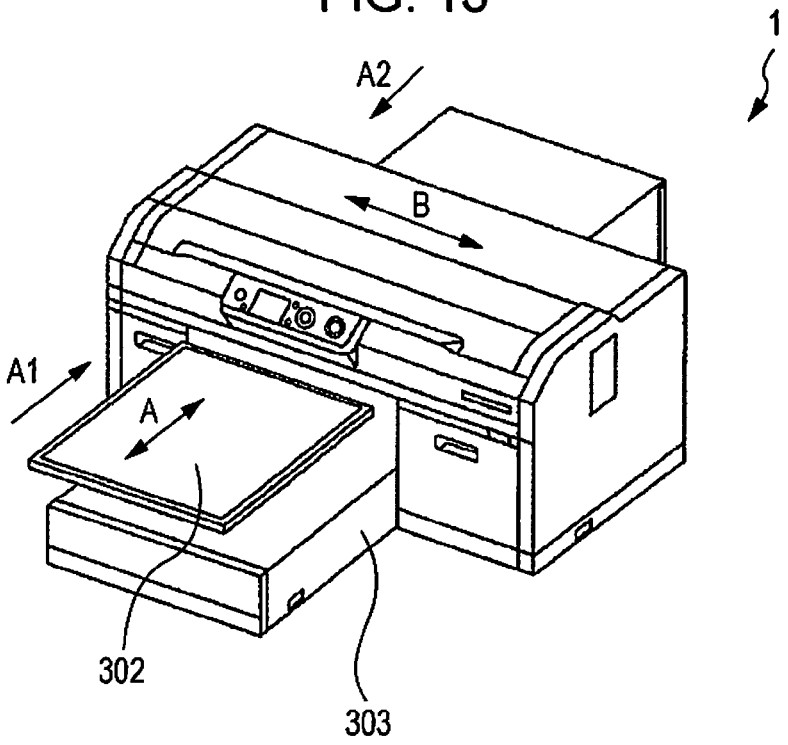
FIG. 13 is a schematic perspective view illustrating an example of a liquid ejecting apparatus as a textile ink jet printer.

FIG. 13 is a schematic perspective view illustrating an example of the liquid ejecting apparatus 1 as the textile ink jet printer. As illustrated in FIG. 13, the liquid ejecting apparatus 1 (textile ink jet printer) includes a tray 302 capable of supporting a recording target medium (fabric) and a transport unit 303 which is a moving mechanism of the tray 302. For example, a user puts on and sets a T-shirt to the tray 302 from a hem portion side of the T-shirt in a setting direction Al so that a portion of the T-shirt desired to be recorded is positioned on an upper surface of the tray 302. The transport unit 303 transports a recording target medium supported by the tray 302 in a transport direction A (the setting direction Al and a direction A2 opposite to the setting direction Al). The head unit 2 (not illustrated) is provided on an inside of a main body of the liquid ejecting apparatus 1. While reciprocating the head unit 2 in a direction B intersecting the transport direction A of the recording target medium, the liquid ejecting apparatus 1 causes the head uni, 2 to eject an ink to the recording target medium supported and transported by the tray 302 to form a desired image.

In addition, for example, the head unit 2 may be used for a label ink jet printer which prints a receipt, a product label, a ticket, and the like. The label ink jet printer is mainly used in a supermarket cash register in cooperation with a POS system, an airport counter, a factory which performs printing of a package label of grocery, and the like and is required to print large volumes of data of different format at high speed, to operate stably, and the like.

Figure 14:
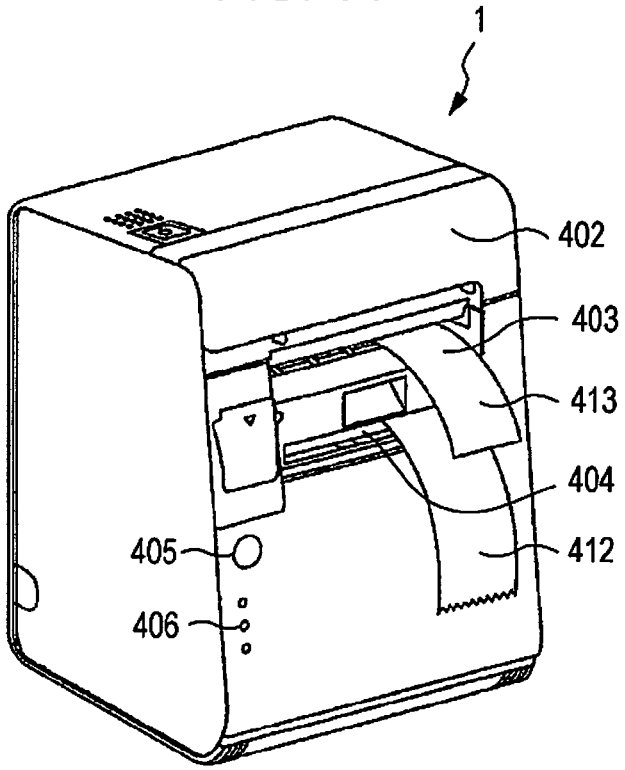
FIG. 14 is a schematic perspective view illustrating an example of a liquid ejecting apparatus as a label ink jet printer.

FIG. 14 is a schematic perspective view illustrating an example of the liquid ejecting apparatus 1 as the label ink jet printer. The liquid ejecting apparatus 1 (label ink jet printer) illustrated in FIG. 14 includes a case 402 having a rectangular parallelepiped shape. A label issue port 403 (outlet) is formed on an upper side of a front surface of the case 402 and a mount outlet 404 is formed on a lower side of the label issue port 403. In addition, a paper feed button 405 and a plurality of LED lamps 406 for notifying an operation state and the like are disposed on a front surface of the liquid ejecting apparatus 1. A roll paper loading unit (not illustrated) is formed on an inside of the case 402 and a roll paper (not illustrated) having a configuration in which a roll is loaded in a roll shape in the roll paper loading unit. The roll paper is configured by sticking a plurality of labels 413 detachably at regular intervals on one surface side of an elongated mount 412 having a fixed width. In addition, the head unit 2 (not illustrated) which performs predetermined printing on the label 413 of the roll paper and a transport mechanism which transports the roll paper are disposed in an inside of the case 402. Then, by various types of mechanisms (not illustrated) provided on the inside of the case 402, the printed label 413 stuck to a surface of the mount 412 is detached from the mount 412 and is issued from the label issue port 403, and the mount 412 is discharged from the mount outlet 404.

In addition, for example, the head unit 2 may be used in an industrial ink jet printer (manufacturing apparatus) used for manufacturing an organic electro-luminescence (OEL) device, a color filter for a liquid crystal, or the like by a droplet ejecting method. The industrial ink jet printer is mainly used for manufacturing industrial products such as a liquid crystal color filter and an organic electro-luminescence device, and the like and is required to have ejection weight accuracy, enlargement to improve productivity, downsizing for improvement in concentration of finished products (high resolution of an ejecting unit), or the like.

Figure 15:
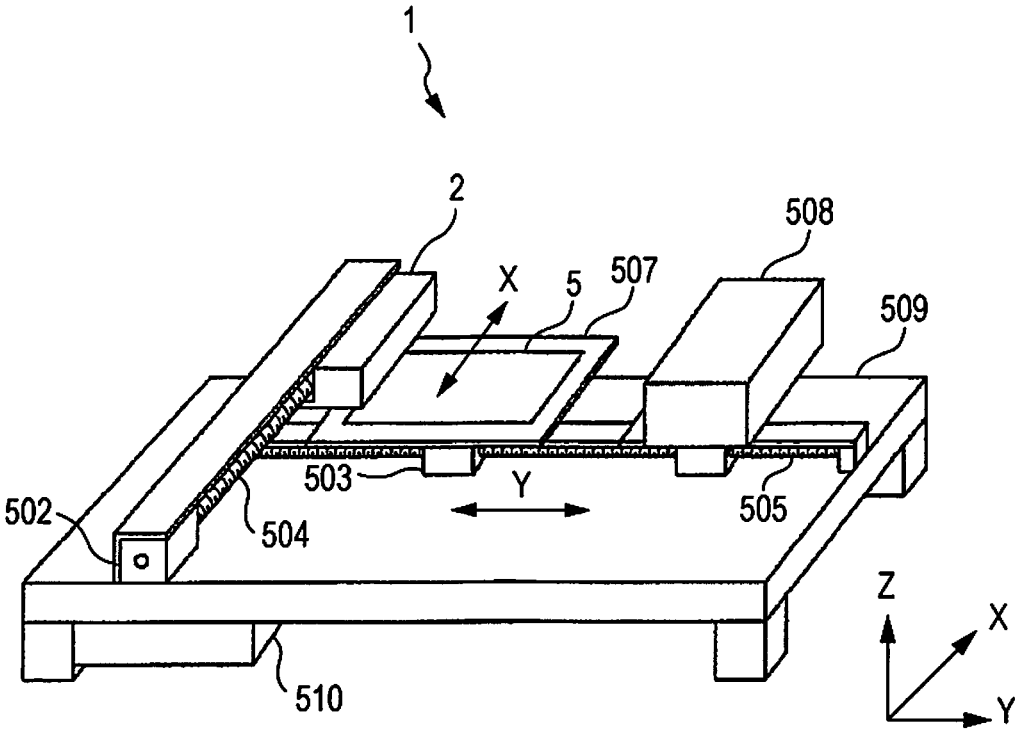
FIG. 15 is a schematic perspective view illustrating an example of a liquid ejecting apparatus as an industrial ink jet printer.

FIG. 15 is a schematic perspective view illustrating an example of the liquid ejecting apparatus 1 as the industrial ink jet printer. The liquid ejecting apparatus 1 (industrial ink jet printer) illustrated in FIG. 15 includes a base 509, a stage 507 which is provided on the base 509 and supports a substrate 5 for an electroluminescent device, a Y axis direction driving motor 503 which drives the stage 507 on the base 509 in the Y axis direction, a Y axis direction guide shaft 505 which guides a movement of the stage 507 in the Y axis direction, the head unit 2 which ejects a liquid material on the substrate 5 supported by the stage 507, an X axis direction driving motor 502 which drives the head unit 2 in the X axis direction, an X axis direction guide shaft 504 which guides a movement of the head unit 2 in the X axis direction, a cleaning mechanism 508, and a control device 510 which controls operation of the liquid ejecting apparatus 1. The stage 507 supports the substrate 5 and includes a fixing mechanism (not illustrated) for fixing the substrate S at a reference position. The Y axis direction guide shaft 505 is fixed so as not to move with respect to the base 509. The Y axis direction driving motor 503 is a stepping motor or the like. When a driving signal in the Y axis direction is supplied from the control device 510, the Y axis direction driving motor 503 moves the stage 507 in the Y axis direction. The cleaning mechanism 508 cleans the head unit 2. The cleaning mechanism 508 includes a driving motor (not illustrated) in the Y axis direction. The driving motor in the Y axis direction drives the cleaning mechanism 508 and the cleaning mechanism 508 is moved along the Y axis direction guide shaft 505. The control device 510 also controls a movement of the cleaning mechanism 508. The control device 510 supplies a signal for ejecting a droplet to the head unit 2. In addition, a driving pulse signal for controlling a movement of the head unit 2 in the X axis direction is supplied to the X axis direction driving motor 502 and a driving pulse signal for controlling a movement of the stage 507 in the Y axis direction is supplied to the Y axis direction driving motor 503. The X axis direction driving motor 502 is a stepping motor or the like. When a driving signal in the X axis direction is supplied from the control device 510, the X axis direction driving motor 502 rotates the X axis direction guide shaft 504. When the X axis direction guide shaft 504 is rotated, the head unit 2 is moved in the X axis direction. A droplet of a liquid material is ejected from a nozzle of the head unit 2 on the substrate 5 supported by the stage 507. This liquid material includes a material for forming an organic layer including a light emitting layer on the substrate 5. Then, by ejecting a droplet while moving the head unit 2, the substrate 5 for an electroluminescent device is manufactured.

In addition, in the embodiment and the modification example, the head unit 2 (printer head) for driving a piezoelectric element is described as an example, but the head unit according to the invention is not limited thereto. The invention can be applied to a device having a similar structure manufactured using MEMS technology, for example, a liquid crystal driving device, a liquid crystal manufacturing device, a MEMS sensor, and the like and the same effect is also obtained by such applications.

The present embodiment, the modification example, and the application example are described above, but the invention is not limited to the present embodiment, the modification example, and the application example. The invention can be implemented in various modes without departing from a gist thereof. For example, it is also possible to appropriately combine the embodiment described above, the modification example, and the application example.

The invention includes substantially the same configuration as the configuration described in the embodiment (for example, a configuration having the same function, method and result or a configuration having the same object and effect). In addition, the invention includes a configuration in which non-essential parts of the configuration described in the embodiment are replaced. Further, the invention includes a configuration which achieves the same operational effect as the configuration described in the embodiment or a configuration which can achieve the same object. In addition, the invention includes a configuration in which a known technology is added to the configuration described in the embodiment.

What is claimed is:

1. A head unit comprising:

a plurality of ejecting units that eject liquids;

a driving IC that drives the plurality of ejecting units;

a first substrate;

a second substrate;

a first electrode; and a second electrode, wherein the first substrate is a rectangular shape that has a first short side, a first long side, a second short side, and a second long side in plan view, the driving IC is a rectangular shape that has a third short side, a third long side, a fourth short side, and a fourth long side in plan view, on the first substrate, a first wiring extended in a direction from a side of the first short side to the second short side, a second wiring separated from the first wiring and extended in a direction from a side of the second short side to the first short side, and a first terminal to which a signal from the second substrate is input on the side of the first short side are provided, on the driving IC, a third wiring extended in a direction from a side of the third short side to the fourth short side is provided, the first electrode electrically connects the first wiring and the third wiring with each other, the second electrode electrically connects the second wiring and the third wiring with each other, the driving IC is overlapped with the first substrate in plan view of the first substrate, and the signal from the second substrate is transmitted from the second substrate in order of the first terminal, the first wiring, the first electrode, the third wiring, the second electrode, and the second wiring.

2. The head unit according to claim 1, wherein a length of the first long side is equal to or larger than 10 times a length of the first short side, and a length of the third long side is equal to or larger than 10 times a length of the third short side.

3. The head unit according to claim 1, wherein the first wiring and the second wiring are provided on the first substrate in a straight line shape.

4. The head unit according to claim 1, wherein a width of the first wiring in a short side direction is larger than a width of the third wiring in a short side direction in plan view of the first substrate.

5. The head unit according to claim 1 wherein the third wiring is overlapped with the first wiring and the second wiring in plan view of the first substrate.

6. The head unit according to claim 1, wherein on the first wiring, a second terminal is provided at a position between the first short side and the first electrode and not overlapping with the driving IC in plan view of the first substrate, and on the second wiring, a third terminal is provided at a position between the second electrode and the second short side and not overlapping with the driving IC in plan view of the first substrate.

7. The head unit according to claim 6, wherein the second terminal and the third terminal are terminals for inspection.

8. The head unit according to claim 1, wherein the first electrode and the second electrode are provided on the first substrate.

9. The head unit according to claim 1, wherein at least a part of each of the first electrodes and the second electrodes is provided on a surface of a resin layer extended in a direction from the first short side to the second short side.

10. The head unit according to claim 1, wherein the signal from the second substrate is a power supply voltage signal.

11. The head unit according to claim 1, wherein the signal from the second substrate is a signal that is an original signal for driving each of the plurality of ejecting units.

12. The head unit according to claim 1, that is used for an industrial ink jet printer.

13. The head unit according to claim 1, that is used for a textile ink jet printer.

14. The head unit according to claim 1, that is used for a label ink jet printer.

15. The head unit according to claim 1, that is used for a business ink jet printer.

* * * * *